US006640073B2

(12) United States Patent
Kurotori et al.

(10) Patent No.: US 6,640,073 B2
(45) Date of Patent: Oct. 28, 2003

(54) LIQUID IMAGE FORMATION APPARATUS AND LIQUID DEVELOPING DEVICE

(75) Inventors: Tsuneo Kurotori, Tokyo (JP); Tsutomu Sasaki, Kanagawa (JP); Mie Yoshino, Kanagawa (JP); Noriyasu Takeuchi, Kanagawa (JP); Tohru Nakano, Kanagawa (JP); Yusuke Takeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/050,959

(22) Filed: Jan. 22, 2002

(65) Prior Publication Data

US 2002/0098016 A1 Jul. 25, 2002

(30) Foreign Application Priority Data

| | | |
|---|---|---|
| Jan. 23, 2001 | (JP) | 2001-014212 |
| Mar. 16, 2001 | (JP) | 2001-076030 |
| Mar. 23, 2001 | (JP) | 2001-084682 |
| Mar. 23, 2001 | (JP) | 2001-085829 |

(51) Int. Cl.[7] ..... G03G 15/10
(52) U.S. Cl. ..... 399/237; 399/249; 399/348
(58) Field of Search ..... 399/249, 239, 399/237, 348, 343, 359; 430/117

(56) References Cited

U.S. PATENT DOCUMENTS

| | | | | |
|---|---|---|---|---|
| 4,052,959 A | * | 10/1977 | Hayashi et al. | 399/249 |
| 5,021,834 A | | 6/1991 | Tsuruoka et al. | |
| 5,155,534 A | | 10/1992 | Kurotori et al. | |
| 5,289,203 A | | 2/1994 | Takeuchi | 347/206 |
| 5,359,398 A | * | 10/1994 | Echigo et al. | 399/348 X |
| 5,374,980 A | * | 12/1994 | Kubo et al. | 399/237 X |
| 5,642,188 A | | 6/1997 | Mochizuki et al. | 399/237 |
| 5,652,080 A | | 7/1997 | Yoshino et al. | 430/119 |
| 5,666,616 A | | 9/1997 | Yoshino et al. | 399/240 |
| 5,708,938 A | | 1/1998 | Takeuchi et al. | 399/250 |
| 5,809,388 A | | 9/1998 | Inada et al. | 399/320 |
| 5,864,737 A | | 1/1999 | Obu et al. | 399/176 |
| 5,923,930 A | | 7/1999 | Tsukamoto et al. | 399/237 |

(List continued on next page.)

FOREIGN PATENT DOCUMENTS

| | | | |
|---|---|---|---|
| JP | 01-206379 | * | 8/1989 |
| JP | 7-21935 | | 1/1995 |
| JP | 7-152254 | | 6/1995 |
| JP | 7-209922 | | 8/1995 |
| JP | 2000-47490 | | 2/2000 |
| JP | 2000-242088 | | 9/2000 |
| JP | 2001-228717 | | 8/2001 |

*Primary Examiner*—Sophia S. Chen
(74) *Attorney, Agent, or Firm*—Oblon, Spivak, McClelland, Maier & Neustadt, P.C.

(57) ABSTRACT

An excess toner removal area is made broader over the whole area with respect to a developer applied area that is broader than an image effective area. Thereby a liquid developer, that tends to spread slightly broader than the applied area after being applied to a photoreceptor drum, is removed by a sweep roller that can sweep excess toner present in an area broader than the original applied area and an excess toner remaining area is then prevented from being formed on the photoreceptor drum. Accordingly, the excess toner on the latent image carrier is removed as much as possible, and a transfer medium and peripheral members are prevented from being soiled due to residual excess toner.

7 Claims, 23 Drawing Sheets

U.S. PATENT DOCUMENTS

| | | | | |
|---|---|---|---|---|
| 5,937,247 | A | 8/1999 | Takeuchi et al. | 399/237 |
| 5,987,281 | A | 11/1999 | Kurotori et al. | 399/237 |
| 5,999,779 | A | 12/1999 | Takeuchi | 399/239 |
| 6,038,421 | A | 3/2000 | Yoshino et al. | 399/239 |
| 6,061,540 | A | 5/2000 | Takeda | 399/237 |
| 6,108,508 | A | 8/2000 | Takeuchi et al. | 399/238 |
| 6,115,576 | A | 9/2000 | Nakano et al. | 399/302 |
| 6,131,001 | A | 10/2000 | Tsukamoto et al. | 399/57 |
| 6,134,394 | A | 10/2000 | Tsukamoto et al. | 399/30 |
| 6,148,169 | A | 11/2000 | Tsukamoto | 399/328 |
| 6,154,624 | A | 11/2000 | Sasaki et al. | 399/250 |
| 6,219,500 | B1 * | 4/2001 | Byun | 399/249 X |
| 6,236,825 | B1 | 5/2001 | Takeuchi | 399/237 |
| 6,324,374 | B1 | 11/2001 | Sasamoto et al. | 399/298 |
| 6,347,212 | B1 | 2/2002 | Kosugi et al. | 399/348 |
| 6,370,347 | B1 * | 4/2002 | Shin et al. | 399/249 |
| 6,505,014 | B2 | 1/2003 | Aoki et al. | 399/55 |
| 6,507,720 | B2 | 1/2003 | Kabumoto et al. | 399/258 |

* cited by examiner

LIQUID IMAGE FORMATION APPARATUS AND LIQUID DEVELOPING DEVICE

FIELD OF THE INVENTION

The present invention relates to a liquid image formation apparatus and a liquid developing device used for electrophotographic wet-type copiers, printers, or facsimiles.

BACKGROUND OF THE INVENTION

Conventionally, there have been known various types of liquid image forming devices that perform development using a liquid developer consisting of a carrier liquid and toner dispersed therein (see e.g., Japanese Patent Application Laid-Open No. 7-209922, Japanese Patent Application Laid-Open No. 7-152254, or Japanese Patent Application Laid-Open No. 7-21935). Further, the applicant of this invention has proposed an image forming method in Japanese Patent Application No. 11-38447, in which a developer carrier having an elastic layer is brought into contact with a latent image carrier to form a nip part for development. In this image forming method, a thin layer of a liquid developer is formed on the developer carrier, and a carrier liquid and toner in the thin layer are electrostatically transferred to an image portion of a latent image on the latent image carrier that forms the developing nip part, where development is performed. On the other hand, toner is inhibited from adhering to a background portion (non-image portion) of the latent image carrier passing through the developing nip part but a slight amount of carrier liquid is allowed to migrate thereto.

Even if the toner adheres to the background portion, the toner can be moved to the developer carrier to be removed while the background portion is passing through the developing nip part.

However, in the method of moving the toner on the non-image portion to the developer carrier and removing it, the toner may adhere to the background portion (non-image portion) of the latent image carrier passing through the developing nip part and remain thereon as excess toner. Thus, image fog may occur due to the excess toner.

To solve the problem, the applicant of this invention has proposed a device provided with a removing member, that removes excess toner on the latent image carrier after development, located downstream the developing nip part in a direction in which the surface of the latent image carrier moves in order to form high quality images by preventing image fog due to excess toner (see Japanese Patent Application No. 2000-42582).

Further, in Japanese Patent Application No. 2000-42582, the applicant of this invention has also proposed provision of a cleaning unit for cleaning the surface of the removing member in order to maintain removal performance of the removing member that removes the excess toner on the latent image carrier by coming into contact with the surface of the latent image carrier.

Conventionally, there has been known a liquid developing device that applies a liquid developer consisting of a carrier liquid and toner dispersed therein to an elastic developing roller, brings the developing roller by pressure into contact with a photoreceptor as a latent image carrier where an electrostatic latent image is formed, develops the electrostatic latent image using the liquid developer applied to the developing roller, and removes the toner adhering to the background of the latent image carrier using a sweep roller.

The conventional liquid developing device forms a predetermined contact width (nip) by bringing the developing roller into contact with the photoreceptor and pressuring the roller against the photoreceptor, moves the toner dispersed in the liquid developer adhering to the developing roller to the photoreceptor, and adhere the toner to an electrostatic latent image formed on the photoreceptor to visualize the electrostatic latent image thereon.

In Japanese Patent Application Laid-Open No. 2000-242088, the applicant of this invention has proposed an image forming method of forming a nip part by bringing a developer carrier having an elastic layer into contact with a latent image carrier. In this image forming method, a thin layer of a liquid developer is formed on the developer carrier, and the carrier liquid and toner in the thin layer are electrostatically transferred to an image portion of the latent image on the latent image carrier to perform development. On the other hand, the toner is inhibited from adhering to the background portion (non-image portion) on the latent image carrier passing through the nip part but a small amount of carrier liquid is allowed to migrate toward the background. Even if the toner adheres to the background, the toner can be removed by being transferred to the developer carrier while the background is passing through the nip part.

However, in a structure in which a removing member for removing excess toner from the latent image carrier is provided, if an area where the toner is removed by the removing member is smaller relative to an area where the liquid developer is applied to the latent image carrier, the excess toner may not fully be removed. Resultantly, an excess toner remaining area may occur on the latent image carrier.

An area where the liquid developer is applied to the surface of the latent image carrier covers an area where an image becomes effective through development (hereafter called "effective image area"), therefore, the area is generally set to be slightly broader than the effective image area. It is generally thought that an area where excess toner is removed by the removing member also covers the effective image area and is therefore set to be slightly broader than this effective image area.

In this case, even if the excess toner removal area is made broader than the effective image area, it may be narrower than the liquid developer applied area. Therefore, the toner outside the excess toner removal area and within the liquid developer applied area is not removed to remain on the surface of the latent image carrier.

If the excess toner is left on the latent image carrier, a transfer medium for transferring the image on the latent image carrier therefrom, may be soiled with the excess toner and so are the peripheral members.

Image fog due to the excess toner is found more noticeable particularly when a highly viscous and highly concentrated liquid developer is used. Consequently, necessity of the removing member is increased.

On the other hand, the conventional liquid developing device is so constructed that the developing roller is always pressurized against and in contact with the photoreceptor. Therefore, if the developing roller is in contact with the photoreceptor and left standing as it is for long time, distortion may occur in the developing roller. Further, the surface of the photoreceptor in contact with the developing roller may be soiled.

Therefore, it is conceivable that the developing roller is separated from the photoreceptor when the liquid developing device is not in use. However, if the photoreceptor and the developing roller are brought into contact with or separated from each other, the surface of the developing roller and the surface of the photoreceptor may be damaged or scratched due to a difference between a rotating speed of the photoreceptor and that of the developing roller.

Abnormal discharge may occur immediately before the developing roller comes into contact with the photoreceptor or immediately after the developing roller separates from the photoreceptor due to a potential difference between the surface of the developing roller and that of the photoreceptor, thereby the surface of the developing roller or the surface of the photoreceptor may be damaged.

Further, the toner adheres to the photoreceptor, which causes the toner consumption to increase.

In the image forming method proposed in Japanese Patent Application Laid-Open No. 2000-242088 as mentioned above, the toner may adhere to the background portion (non-image portion) on the latent image carrier passing through the nip part and remain as excess toner. In this case, image fog due to this excess toner may occur. Further, the carrier liquid adhering to the image portion and non-image portion may be unnecessarily consumed.

SUMMARY OF THE INVENTION

It is an object of this invention to provide a liquid image formation apparatus capable of preventing a transfer medium and peripheral members from being soiled due to residual excess toner by removing the excess toner on a latent image carrier as much as possible.

Another object of this invention is to provide a liquid developing device capable of enhancing reliability and durability of a developing roller by eliminating permanent distortion of the developing roller due to being in a pressure and contact state.

A further object of this invention is to provide a liquid developing device and an image formation apparatus capable of forming high quality images by preventing image fog and of reducing a carrier liquid.

The liquid image formation apparatus according to one aspect of this invention comprises a latent image carrier which carries a latent image on its surface, a developer carrier which carries a liquid developer consisting of a carrier liquid and toner dispersed therein, on its surface, and an applying unit which applies the liquid developer to the developer carrier in a predetermined width. The liquid image formation apparatus develops the latent image by the liquid developer carried on the developer carrier, in a development area as an area where the developer carrier and the latent image carrier face each other. The liquid image formation apparatus further comprises are moving unit, which removes excess toner on the latent image carrier after development, located downstream the development area in the direction in which the surface of the latent image carrier moves, and an area in which the removing unit removes excess toner on the surface of the latent image carrier is made broader than an area in which the applying unit applies a liquid developer onto the surface of the latent image carrier.

Making the excess toner removal area broader than the liquid developer applied area mentioned here indicates that the excess toner removal area covers the liquid developer applied area, and further covers areas adjacent to end parts of the liquid developer applied area over the whole area.

According to this invention, excess toner is removed from the whole liquid developer applied area where the excess toner is thought to occur on the latent image carrier. The liquid developer may be spread slightly broader than an applied area after being applied to the latent image carrier. This invention, however, is free from occurrence of any excess toner remaining area where residual excess toner remains on the latent image carrier without being removed because the excess toner is removed from an area broader than the original liquid developer applied area by making the excess toner removal area broader than the applied area.

A cleaning member in contact with the surface of a removing member is used here as a cleaning unit. If the width in a main scanning direction of the removing member is wider than the width in the main scanning direction of the cleaning member, as shown in FIG. 5, the removed excess toner is brought to both ends of the cleaning member and re-adheres in a streak to the surface of the removing member. The streaked toner is pressed and spread at the contact part between the removing member and the latent image carrier to remain between the removing member and the latent image carrier. This may bring about lowering of a function of the removing member that removes the excess toner from the surface of the latent image carrier.

The liquid developing device according to another aspect of this invention applies a liquid developer consisting of a carrier liquid and toner dispersed therein to an elastic developing roller, brings the developing roller by pressure into contact with a latent image carrier where an electrostatic latent image is formed, develops the electrostatic latent image using the liquid developer applied to the developing roller, and removes the toner adhering to the background portion of the latent image carrier with a sweep roller. In this apparatus, the developing roller can come into contact with and separate from the latent image carrier.

According to this invention, permanent distortion of the developing roller due to being in a pressure and contact state is eliminated to enable enhancement in reliability and durability of the developing roller.

The liquid developing device according to still another aspect of this invention applies a liquid developer consisting of a carrier liquid and toner dispersed therein to an elastic developing roller, brings the developing roller by pressure into contact with a latent image carrier where an electrostatic latent image is formed, develops the electrostatic latent image using the liquid developer applied to the developing roller, and removes the toner adhering to the background portion of the latent image carrier with a sweep roller.

This liquid developing device has the following relation:

$$d1/v<0.5$$

where a distance from the developing roller to the sweep roller in the rotating direction of the latent image carrier is d1, and linear velocity of the latent image carrier is v, and where a unit of the distance d1 is mm and a unit of the linear velocity v of the latent image carrier is mm/sec.

According to this invention, a time required until the contact part of the photoreceptor with the developing roller reaches the sweep roller is set to 0.5 sec or below, thus obtaining excellent developing characteristics with less image degradation.

The liquid developing device according to still another aspect of this invention comprises at least one developer carrier which carries a highly viscous and highly concentrated liquid developer consisting of a carrier liquid and toner dispersed therein, and an applying member which applies the liquid developer to the developer carrier. The liquid developing device develops a latent image formed on a latent image carrier by the liquid developer carried on the developer carrier. The liquid developing device further comprises at least one sweep roller formed of an elastic body for removing excess developer on the latent image carrier after development, located downstream the developer carrier in the direction in which the surface of the latent image carrier moves; and a nip forming unit which forms a nip between the sweep roller and the latent image carrier. The liquid developing device also comprises a sweep voltage applying unit which applies a voltage to the sweep roller, a rotation driving unit which drives to rotate the sweep roller, a contact/separation unit which brings the sweep roller into contact with and separates the roller from the latent image carrier, and a cleaning unit which cleans the sweep roller.

The liquid developing device according to still another aspect of this invention comprises at least one developer carrier which carries a highly viscous and highly concentrated liquid developer consisting of a carrier liquid and toner dispersed therein, and an applying member which applies the liquid developer to the developer carrier. The liquid developing device develops a latent image formed on a latent image carrier by the liquid developer carried on the developer carrier. The liquid developing device further comprises at least one removing member which removes excess toner and carrier on the latent image carrier after development, located downstream the developer carrier in the direction in which the surface of the latent image carrier moves, and a cleaning unit that cleans the surface of the removing member as a roller. The cleaning unit is a blade member, and its contact position with respect to the roller as the removing member is a central position or lower in the vertical direction.

The liquid developing device according to still another aspect of this invention comprises a developer carrier which carries a liquid developer consisting of a carrier liquid and toner dispersed therein. The liquid developing device supplies a liquid developer carried on the developer carrier to a latent image carrier to develop a latent image. The liquid developing device further comprises at least one sweep roller, which removes excess liquid developer adhering to the surface of the latent image carrier after development, located downstream the surface of the latent image carrier, and the sweep roller is formed of an elastic body.

The liquid developing device according to still another aspect of this invention comprises a developer carrier which carries a liquid developer consisting of a carrier liquid and toner dispersed therein. This liquid developing device supplies the liquid developer carried on the developer carrier to a latent image carrier to develop a latent image. The developer carrier is formed of urethane base resin so as to have conductivity, and at least one sweep roller, which removes excess liquid developer adhering to the surface of the latent image carrier after development, is provided on the downstream side of the surface of the latent image carrier.

Other objects and features of this invention will become understood from the following description with reference to the accompanying drawings.

BRIEF DESCRIPTION OF THE DRAWINGS

FIG. 9A shows a state of the toner immediately after development, and FIG. 9B shows a state of the toner after 0.5 sec elapses from immediately after the development;

DETAILED DESCRIPTIONS

The present invention relates to a liquid image formation apparatus and a liquid developing device used for electrophotographic wet-type copiers, printers, facsimiles, or the like. More particularly, this invention relates to the liquid image formation apparatus which comprises at least one developer carrier that carries a liquid developer consisting of a carrier liquid and toner dispersed therein, and an applying member that applies the liquid developer to the developer carrier, and which develops a latent image formed on a latent image carrier by the liquid developer carried on the developer carrier. This invention also relates to the liquid developing device (which is also called a wet-type developing device) that develops the image using the liquid developer consisting of a carrier liquid and toner dispersed therein.

One embodiment in which this invention is applied to an electrophotographic wet-type printer (hereafter simply called "printer") as the liquid image formation apparatus of this invention will be explained below.

The schematic construction of this printer will be explained first.

Figure 1:
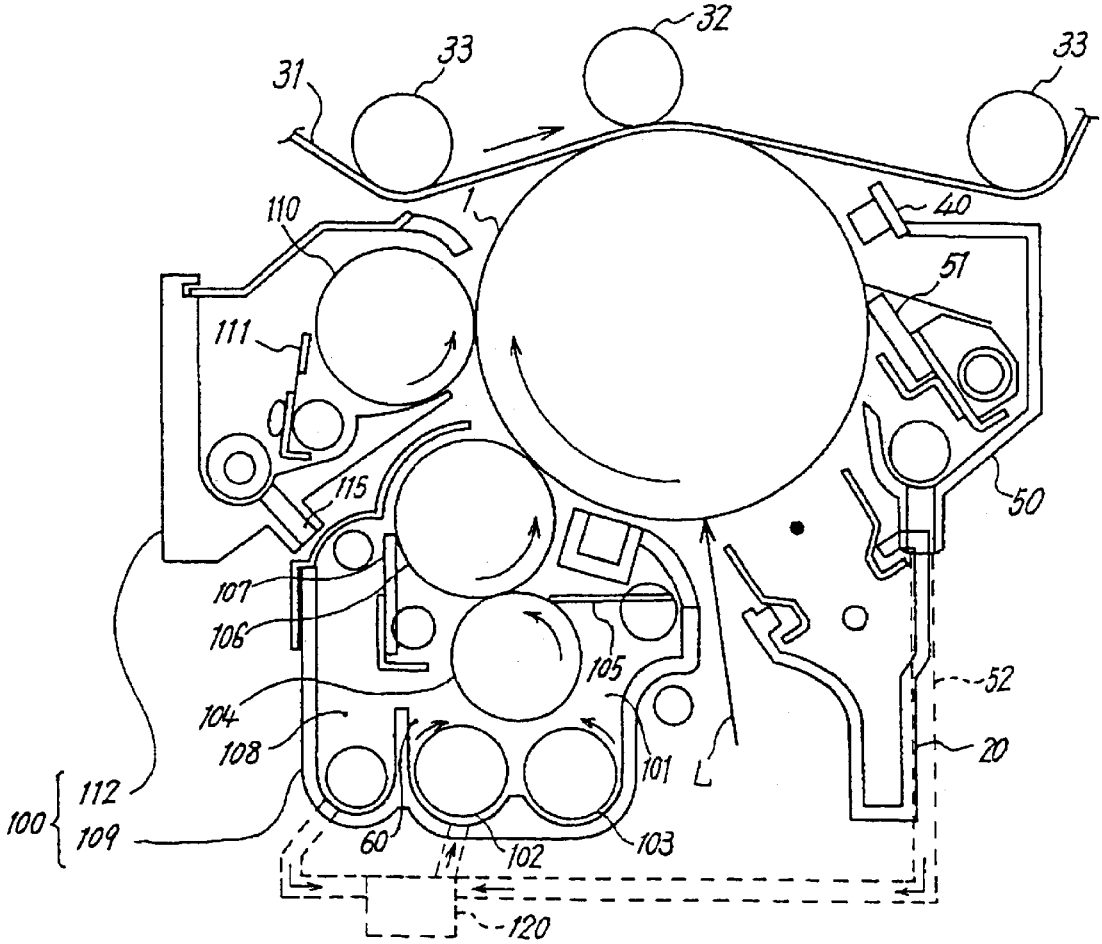
FIG. 1 shows a key section of a liquid image formation apparatus according to an embodiment.

FIG. 1 schematically shows the key section of a printer according to a first embodiment. In this figure, the printer comprises the charger 20, exposing device, not shown, that irradiates exposure light L to the photoreceptor drum 1, wet-type developing device 100, transfer device composed of the intermediate transfer belt 31 and transfer roller 32, discharge lamp 40, and the drum cleaning device 50, each of which is disposed around the photoreceptor drum 1 as a latent image carrier.

The surface of the photoreceptor drum 1 is formed of amorphous silicon (a-Si), and is driven to rotate in the direction of the arrow in the figure by a driving unit, not shown, during printing. The photoreceptor drum 1 whose surface is formed of the amorphous silicon (a-Si) exhibits more excellent mechanical strength than that of an organic photoconductor (OPC), prolongs its life, and enhances the level of safety.

The charger 20 uniformly charges the surface of the photoreceptor drum 1 driven to rotate in such a manner as explained above by corona discharging in the dark. As the charger 20, in addition to such a device that realizes charging by corona discharging, any device having a method of applying a predetermined charging bias to a charging member such as a charging roller in contact with the photoreceptor drum 1 may be used.

The exposing device has a scanning optical system, and exposes the surface of the photoreceptor drum 1 charged uniformly in such a manner by LED light or a laser beam-based on image information so that the drum 1 carries an electrostatic latent image.

The wet-type developing device (hereafter simply called "developing device") 100 adheres charged toner to the electrostatic latent image formed in such a manner on the surface of the photoreceptor drum 1, and develops the toner to form a toner image on the photoreceptor drum 1.

The transfer device has the intermediate transfer belt 31 shown in the figure, transfer roller 32 and plural stretching rollers 33 that stretch the belt 31, and a power supply (not shown) that applies a transfer bias of the opposite polarity to the polarity of charged toner, to the transfer roller 32. The transfer device endlessly moves the intermediate transfer belt 31 in the direction of the arrow in the figure during printing. This intermediate transfer belt 31 is pressed against the photoreceptor drum 1 by the transfer roller 32 to produce a nip for transfer. The transfer nip has a transfer electric field formed due to a difference in potentials between the transfer roller 32 to which the transfer bias is applied and the surface of the photoreceptor drum 1. The toner image proceeding to the transfer nip with rotation of the photoreceptor drum 1 is primarily transferred to the intermediate transfer belt 31 by the action of the transfer electric field and nip pressure.

The toner image primarily transferred in such a manner is secondarily transferred to a transfer paper in an area not shown, and is then fixed by a fixing device using any of fixing methods such as a heating pressuring fixing method, fixing method with solvent, or a UV fixing method. The transfer paper with the toner image fixed is ejected from this fixing device to the outside of the machine through a paper ejection path.

The discharge lamp 40 discharges residual charges on the surface of the photoreceptor drum 1 after passing through the transfer nip.

The drum cleaning device 50 scrapes and removes the liquid developer adhering to the surface of the photoreceptor drum 1 discharged in such a manner by a photoreceptor cleaning blade 51. With this removal, the surface of the photoreceptor drum 1 is placed in the initial state for the next image formation.

The specific construction of the developing device 100 will be explained below.

The developing device 100 is composed of the developing section 109 comprising the tank section 101, agitating screws 102 and 103, anilox roller 104, regulating blade 105, developing roller 106, cleaning blade 107, and the feedback section 108; and of the sweep section 112 comprising the sweep roller 110 and cleaning blade 111.

The tank section 101 stores a liquid developer 60 containing toner and liquid carrier. A highly viscous and dense liquid is used as the liquid developer 60. This liquid is different from the lowly viscous and lowly concentrated liquid widely used for ordinary wet-type developing devices. The liquid developer having low viscosity and low concentration indicates a liquid developer having a viscosity of about 1 [cst] and containing toner having the concentration of 1 [wt %] in an insulating liquid carrier called, for example, Isopar (Product name: manufactured by Exxon.) currently on the market. The highly viscous and highly concentrated liquid developer indicates a liquid developer having a viscosity of about 50 to 10000 [cSt] and containing toner having the concentration of 5 to 40 [wt %] in an insulating liquid carrier such as silicone oil, normal paraffin, Isopar M (product name: manufactured by Exxon.), vegetable oil, or mineral oil. Volatility or non-volatility of such a highly viscous and highly concentrated liquid developer 60 used for the developing device 100 is regulated for the developing performance of the developing device 100 and image forming performance. Further, the particle size of toner in the liquid developer 60 is also adjusted.

The agitating screws 102 and 103 are disposed in parallel to each other so as to be sunk in the liquid developer 60 of the tank section 101, and are driven to rotate in the directions opposite to each other by a driving unit, not shown, as shown by the arrows in the figure. When the developing device 100 enters into a developing operation, these screws 102 and 103 rotate in the directions opposite to each other, thereby the liquid developer 60 in the tank section 101 is agitated. The toner concentration and viscosity of the liquid developer 60 are made uniform through the agitation. Further, the screws 102 and 103 rotate in the opposite directions, thereby the liquid level of the liquid developer 60 between both screws rises as shown in the figure, and touches the anilox roller 104 disposed above the screws 102 and 103.

The anilox roller 104 as a developer applying body sucks up the liquid developer 60 deposited thereon in such a manner while being driven to rotate in the direction of the arrow in the figure by the driving unit not shown. A plurality of recess parts are formed along the circumferential surface of the anilox roller 104, and part of the liquid developer 60 sucked up by the anilox roller 104 is accommodated in these recess parts.

The regulating blade 105 as a regulating member is formed of metal such as stainless steel, and regulates the amount of the liquid developer 60 sucked up by the anilox roller 104 by coming into contact with the rotating anilox roller 104. The amount of the liquid developer 60 on the anilox roller 104 is measured under this regulation.

The developing roller 106 as a developer carrier is rotated in a counter direction with respect to the rotating direction of the anilox roller 104 while being in contact with the surface of the anilox roller 104 after the amount of the liquid developer is regulated. The developing roller 106 and the anilox roller 104 are in contact with each other while mutually rotating in the counter direction to each other at a developer applied position as a contact position between these tow rollers and the amount of the liquid developer on the anilox roller 104 is accurately measured. The highly viscous liquid developer 60 is thereby applied smoothly to the developing roller 106 with a uniform thickness. A developer thin layer with an even thickness consisting of the liquid developer 60 is formed on the surface of the developing roller 106 through such application.

The developing roller 106 has a conductive elastic layer, which is formed of conductive urethane rubber, provided along its circumferential surface, and forms a developing nip by coming into contact with the photoreceptor drum 1 while rotating at the same speed as that of the drum 1. A development electric field is formed at the developing nip due to a difference between potentials of the developing roller 106, to which a developing bias of the same polarity as that of the charged toner is applied from the power supply not shown, and of the photoreceptor drum 1. More specifically, the developing roller 106, and the background portion and electrostatic latent image of the photoreceptor drum 1 have respective potentials of the same polarity as that of the toner, and the values of the potentials are decreasing in order from the background, developing roller 106, and electrostatic latent image. An electric field is therefore formed between the background portion and the developing roller 106 so as to electrostatically move the toner toward the developing roller 106 having a lower potential. Further, an electric field is formed between the developing roller 106 and the electrostatic latent image so as to electrostatically move the toner toward the electrostatic latent image having a further lower potential. The toner particles in the developer thin layer perform electrophoresis toward the surface of the developing roller 106 between the developing roller 106 and the background to gather at the developing nip where such an electric field for development is formed. Further, the toner particles migrate toward the electrostatic latent image between the developing roller 106 and the electrostatic latent image to adhere to the image. With the adhesion, the electrostatic latent image is developed to become a toner image.

The cleaning blade 107 is formed of a member such as metal and rubber, and scrapes and removes the residual developer from the surface of the developing roller 106 by coming into contact with the surface which has passed through the developing nip. Through this removal, the surface of the developing roller 106 is placed in the initial state. The removed residual developer returns to the tank section 101 through the feedback section 108.

The developing section 109 is constructed to develop the electrostatic latent image on the photoreceptor drum 1 in such a manner.

A developing bias voltage (400 V) lower than a surface potential (600 V) of the photoreceptor is applied to the developing roller 106, so that a development electric field is produced between the developing roller 106 and the image surface that has been exposed by the exposing device and whose voltage has been lowered to 50 V or below. In the image portion of the photoreceptor drum 1, the toner in the developer migrates to the photoreceptor drum 1 by the electric field to visualize the latent image. On the other hand, in the background portion (non-image portion), the toner is moved to the surface of the developing roller due to the electric field formed by the developing bias potential and the photoreceptor potential so that the toner is prevented from adhering to the background portion.

However, if part of the toner in the background portion fails to reach the surface of the developing roller and remains on the photoreceptor drum 1, the toner results in the fog. To solve the problem, the developing device of the copier according to the first embodiment is provided with the sweep roller 110 in order to sweep the excess toner that may bring about the fog. This sweep roller 110 is disposed on the downstream side in the direction of rotating the photoreceptor drum 1 with respect to the developing roller 106 by being pressed against the photoreceptor drum 1 so that the developed toner layer is sandwiched by these two. The surface of the sweep roller 110 moves at substantially the same speed as the surface of the photoreceptor drum 1.

A bias voltage (250 V) close to the surface potential (100 to 200 V) of the toner layer on the photoreceptor drum 1 is applied to the sweep roller 110 so as to prevent the toner from returning from the toner layer after development to the sweep roller 110. In the background portion, the stray excess toner is moved to the sweep roller 110 by the electric field produced by a difference between the potential on the background of the photoreceptor drum 1 and the potential based on the bias voltage. At this stage, the developer layer of the background is about one-half of the thickness at the developing nip part on the developing roller 106, and a toner content lowers to about 20% of the toner content before development. The sweep roller 110 can therefore easily remove the excess toner. Accordingly, the fog in the background can be fully obviated.

By disposing the sweep roller 110, about one-half of the excess carrier liquid deposited on the background of the photoreceptor drum 1 can be removed during development.

Further, the excess toner can be efficiently removed by the sweep roller 110. Therefore, some amount of excess toner may remain at the developing nip between the photoreceptor drum 1 and the developing roller, the electric field for fog removal (a difference between a potential of the developing bias applied to the developing roller and a charge potential of the photoreceptor) can be suppressed to be low. This can lower the charge potential of the photoreceptor drum 1. Accordingly, various advantages as follows are obtained, that is, improvement in durability of the photoreceptor drum 1, reduction in load on the charging roller 2, or reduction in exposure power.

The cleaning blade 111 is formed of a member such as metal and rubber, and scrapes and removes the residual developer from the surface by coming into contact with the surface of the sweep roller 110 after passing through the sweep nip. The surface of the sweep roller 110 can be placed in the initial state through the removal.

The printer of the first embodiment has an excess toner recycle mechanism as an excess toner recycle unit so that the excess toner recovered from the photoreceptor drum 1 by the sweep roller 110 can be recycled for development. The printer also has an after-transfer residual toner recycle mechanism as an after-transfer residual toner cleaning unit so that the residual toner after transfer recovered from the photoreceptor drum 1 by the photoreceptor cleaning blade 51 can be recycled for development as well.

A tank 120 for temporarily accommodating the recovered toner is disposed in front of the developing device. The excess toner removed from the photoreceptor drum 1, swept off from sweep roller 110 by the cleaning blade 111, and recovered in the sweep section 112 is accommodated in the tank 120 by passing through the communicating section 115 from the lower part of the housing of the sweep section toward the feedback section 108.

On the other hand, the after-transfer residual toner swept from the surface of the photoreceptor drum by the photoreceptor cleaning blade 51 of the drum cleaning device 50 is also accommodated in the tank 120 by passing through the tube 52 communicating from the lower part of the housing of the drum cleaning device to the tank 120.

The toner accommodated in the tank 120 is returned to the tank section 101 of the developing section 109 to be recycled for development. The excess toner recycling mechanism and the after-transfer residual toner recycling mechanism have such a construction.

An area where the liquid developer is applied to the surface of the photoreceptor drum (hereafter called "developer applied area") covers an effective image area A, and is generally set slightly broader than this area. And, it is naturally considered that an area where excess toner is removed by the sweep roller 110 also covers the effective image area A and is set slightly broader than this image area. There is a case, however, where the excess toner removal area becomes narrower than the developer applied area even if the excess toner removal area is broader than the effective image area A. In this case, the excess toner fails to be removed in a portion of the developer applied area which becomes a portion beyond the excess toner removal area and remains on the surface of the photoreceptor drum. The excess toner left on the photoreceptor drum 1 soils the intermediate transfer belt 31 on the downstream side in the direction in which the surface of the photoreceptor drum 1 moves to increase the load on the cleaning device of the intermediate transfer belt 31 or to soil peripheral members although an image is not directly affected by the excess toner because the toner remains in the non-image portion. Further, when a color image is to be formed by superposing images in a plurality of colors on the intermediate transfer belt, a plurality of color toner particles are mixed on the intermediate transfer belt 31 and the mixed toner particles therefore cannot be recycled to result in wasteful consumption.

The characteristics of the first embodiment in which the inconveniences can be prevented by using the printer of the first embodiment will be explained below.

Figure 2:
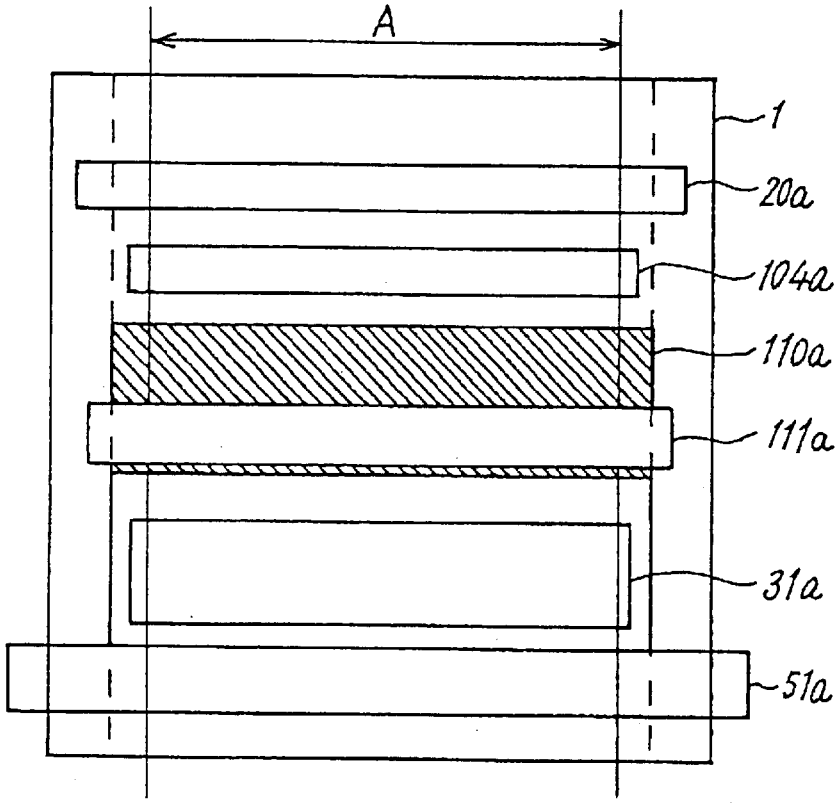
FIG. 2 shows a positional relation of each member disposed around a photoreceptor drum and each area with respect to the surface of the photoreceptor drum.

FIG. 2 shows a positional relation of each member disposed around the photoreceptor drum and each area with respect to the surface of the photoreceptor drum when viewed from the width direction in the main scanning direction of the photoreceptor drum 1 (hereafter simply called "width direction"). This figure shows so as to clearly understand each position of the following areas with respect to the width direction of the surface of the photoreceptor. That is, the areas include the area 110*a* where the excess toner is removed by the sweep roller 110, liquid developer applied area 104*a*, uniformly charged area 20*a* by the charger, intermediate transfer belt facing area 31*a* as a transfer medium facing area which is an area where the intermediate transfer belt 31 comes into contact with the drum, cleaning area 51*a* by the photoreceptor cleaning blade 51, and the width 111*a* where the cleaning blade 111, which cleans the sweep roller 110, delivers its cleaning performance.

In the first embodiment, as shown in FIG. 2, the excess toner removal area 110*a* is made broader over the whole area with respect to the developer applied area 104*a* that is broader than the effective image area, and further, the width 111*a* where the cleaning blade 111 delivers its cleaning performance is widened in both ends with respect to the width of the sweep roller 110.

Accordingly, the liquid developer, which may spread slightly broader than the applied area after being applied to the photoreceptor drum 1, is removed by the sweep roller 110 that can remove the excess toner in a broader area than the original developer applied area. Therefore, any excess toner residual area can be prevented from its occurrence on the photoreceptor drum.

Figure 5:
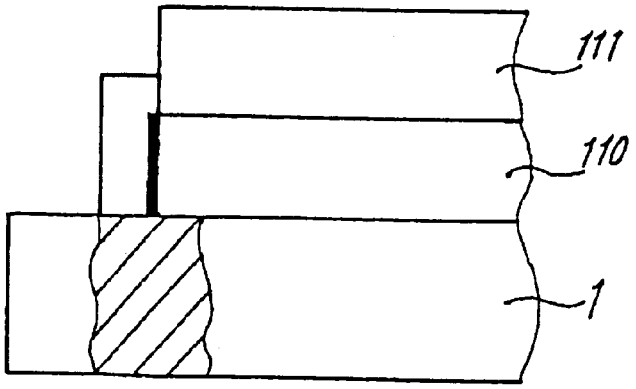
FIG. 5 shows such inconvenience that the excess toner spreading over both ends of the cleaning member re-adheres to the surface of the removing member with streaking.

Further, when the width of the sweep roller 110 is wider than that of the cleaning blade 111, as shown in FIG. 5, the removed excess toner spreads as far as both ends of the cleaning blade 111 and the toner re-adheres in a streak to the surface of the sweep roller 110 to be pressed and spread at the contact part with the photoreceptor drum 1. The spread toner results in remaining between the photoreceptor drum 1 and the sweep roller 110. This residual toner may lower the function of the sweep roller 110 or may re-adhere to the image area of the photoreceptor drum 1.

To solve the above problem, in the first embodiment, the cleaning blade 111 for cleaning the sweep roller 110 is made wider than the width of the sweep roller 110 in both directions, and the width 111*a* where the blade 111 can deliver cleaning performance is made wider in both ends of the sweep roller 110.

Figure 3:
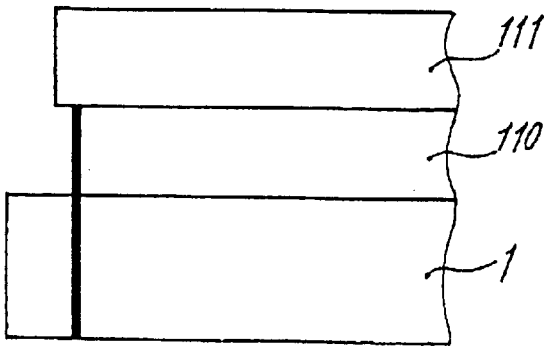
FIG. 3 shows the embodiment in which a cleaning member is extended along both ends in the width direction of the removing member.

Accordingly, as shown in FIG. 3, the excess toner is not pressed and spread at the contact part between the photoreceptor drum 1 and the sweep roller 110, but the excess toner adheres in a streak to an area in the vicinity of the end part in the width direction of the sweep roller and to the surface of the photoreceptor drum corresponding to the position.

This does not lower the cleaning performance although the toner adheres to the ends of the sweep roller 110, and the excess toner can also be prevented from adhering to within the image area of the photoreceptor drum 1.

Figure 6:
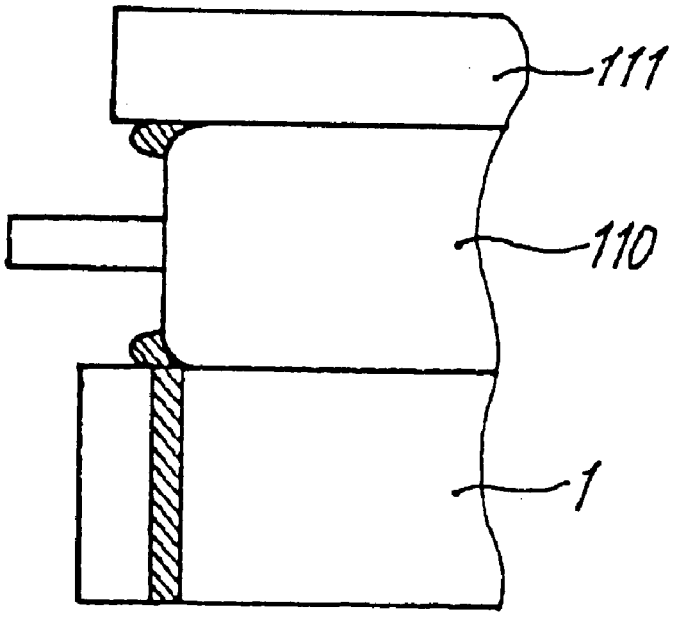
FIG. 6 shows inconvenience when the size of the notched part of the sweep roller edge part is large.

There is a case here where the sweep roller 110 has a lacked end such that the edge of the end part is chamfered or R-machined. Such a shape of the end part forms meniscus at the time of coming in contact with the photoreceptor drum 1 as shown in FIG. 6 if the lacked part is too large, and the removed toner easily re-adheres to the photoreceptor drum 1.

Therefore, in the first embodiment, the shape of the edge of the sweep roller 110 is formed so that a curvature radius is 0.3 mm or below or a chamfering depth is 0.3 mm or below in a chamfer of 45 degrees.

Figure 4:
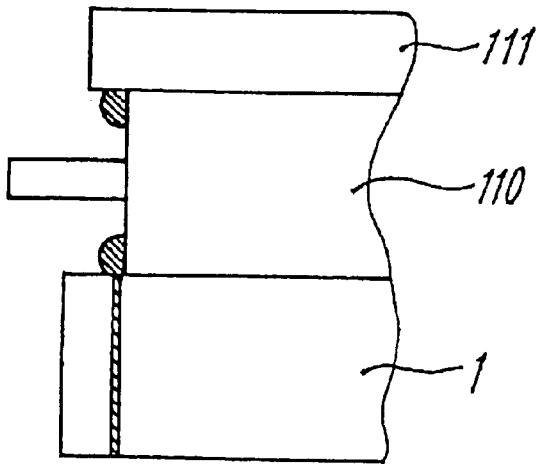
FIG. 4 shows an upper limit in a size of a notch part of a sweep roller edge part.

FIG. 4 shows a case where the excess toner is removed when the sweep roller 110 has the lacked part in its edge and the size of the lacked part is limited to within such a range. By making the lacked part of the edge smaller as explained above, the width of the adhesion of the toner that adheres to the end part of the sweep roller and re-adheres to the surface of the photoreceptor drum can be narrowed as compared to the case where the lacked part of the edge is large as shown in FIG. 6. Accordingly, the amount of re-adhesion of the toner to the photoreceptor drum 1 can be reduced as compared to the case where the edge has a large lacked part.

Further, in the first embodiment, as shown in FIG. 2, the uniformly charged area 20*a* is formed to cover the whole area of the excess toner removal area 110*a*.

Accordingly, the whole excess toner removal area 110*a* is uniformly charged by the charger, and only the image portion is lowered to 50 V or below through exposure. That is, there is no portion left where uniform-charging is not executed to the non-image portion of the end part of the excess toner removal area 110*a* and the potential is lowered close to 0 V. Accordingly, the toner deposited on the sweep roller surface is not attracted to the non-image portion of the end part by the potential, so that the amount of re-adhesion of the toner to the photoreceptor drum 1 can be prevented from increasing.

The above construction enables reduction in the amount of developer re-adhering to the surface of the sweep roller, but does not fully eliminate the re-adhering developer. As shown in FIG. 4, the streaked or ringed toner adhering to the photoreceptor drum is deposited thicker as compared to the toner deposited on the ordinary image area. When the intermediate transfer belt 31 comes into contact with such deposited streaked developer in the transfer area, the developer transfers to the intermediate transfer belt surface, which increases the load on the cleaning device of the intermediate transfer belt 31 or wastefully consumes the developer at the time of color image formation. Further, the load on the device for cleaning the intermediate transfer belt 31 results in increase.

In order to prevent such inconveniences, it is also conceivable that an applied transfer potential in the transfer area is adjusted to prevent a transfer of the developer to the intermediate transfer belt 31 in the non-image area. However, the streaked toner that is extremely thick as compared to the ordinary image portion has difficulty in control of the transfer by the electric field, and the liquid developer transfers and adheres to the intermediate transfer belt surface by physical adhesion of the developer itself.

On the other hand, the streaked developer, that does not transfer to the intermediate transfer belt 31 but remains on the photoreceptor drum surface, is deposited further thicker if the developer is left as it is without being treated, and becomes the form of mist to be scattered to the surrounding during rotation of the photoreceptor drum 1 or drops when the rotation stops. These situations cause the internal printer to be soiled and in addition the developer to be wastefully consumed.

To solve the above problem, in the first embodiment, as shown in FIG. 2, the excess toner removal area 110*a* is made broader than the intermediate transfer belt facing area 31*a*, and further, the cleaning area 51*a* of the photoreceptor drum 1 covers the whole area of the excess toner removal area 110*a* and is made wider than both ends of the area 110*a*.

In order to make the excess toner removal area 110*a* broader than the intermediate transfer belt facing area 31*a*, in the first embodiment, the excess toner removal area 110*a* is set to be wider by 5 mm or above from both ends in the width direction in consideration of positional displacement in the width direction of the intermediate transfer belt 31. According to this setting, an area of the photoreceptor drum surface where the intermediate transfer belt 31 faces the drum and an area adjacent to the area can be cleaned by the cleaning blade. Therefore, the excess toner remaining in streaking on the photoreceptor drum surface is prevented from transferring to the intermediate transfer belt surface. Further, the load on the device for cleaning the intermediate transfer belt 31 can be reduced.

In addition to these advantages, the photoreceptor cleaning blade 51 for cleaning the photoreceptor drum 1 cleans an area including the whole area of the contact area with which the sweep roller 110 comes into contact and extending up to the outside of both ends in the width direction. Accordingly, it is possible to remove also the streaked developer remaining on the photoreceptor drum surface therefrom without transferring of the developer to the intermediate transfer belt 31, and to prevent the developer from scattering or dropping from the photoreceptor drum surface to soil the internal printer. Further, the developer recovered by the photoreceptor cleaning blade 51 is recycled for development. Therefore, wasteful consumption of the developer can be more surely prevented.

In the embodiment, although the apparatus that forms an image of one color on the intermediate transfer belt has been explained, this apparatus can be applied to a color printer provided with a plurality of printers each of which can form an image of different color on the intermediate transfer belt based on the same construction.

In the embodiment, although the intermediate transfer belt has been explained as an example of the transfer medium, this invention can be applied to a monochrome printer that directly transfers an image to a transfer paper.

Figure 7:
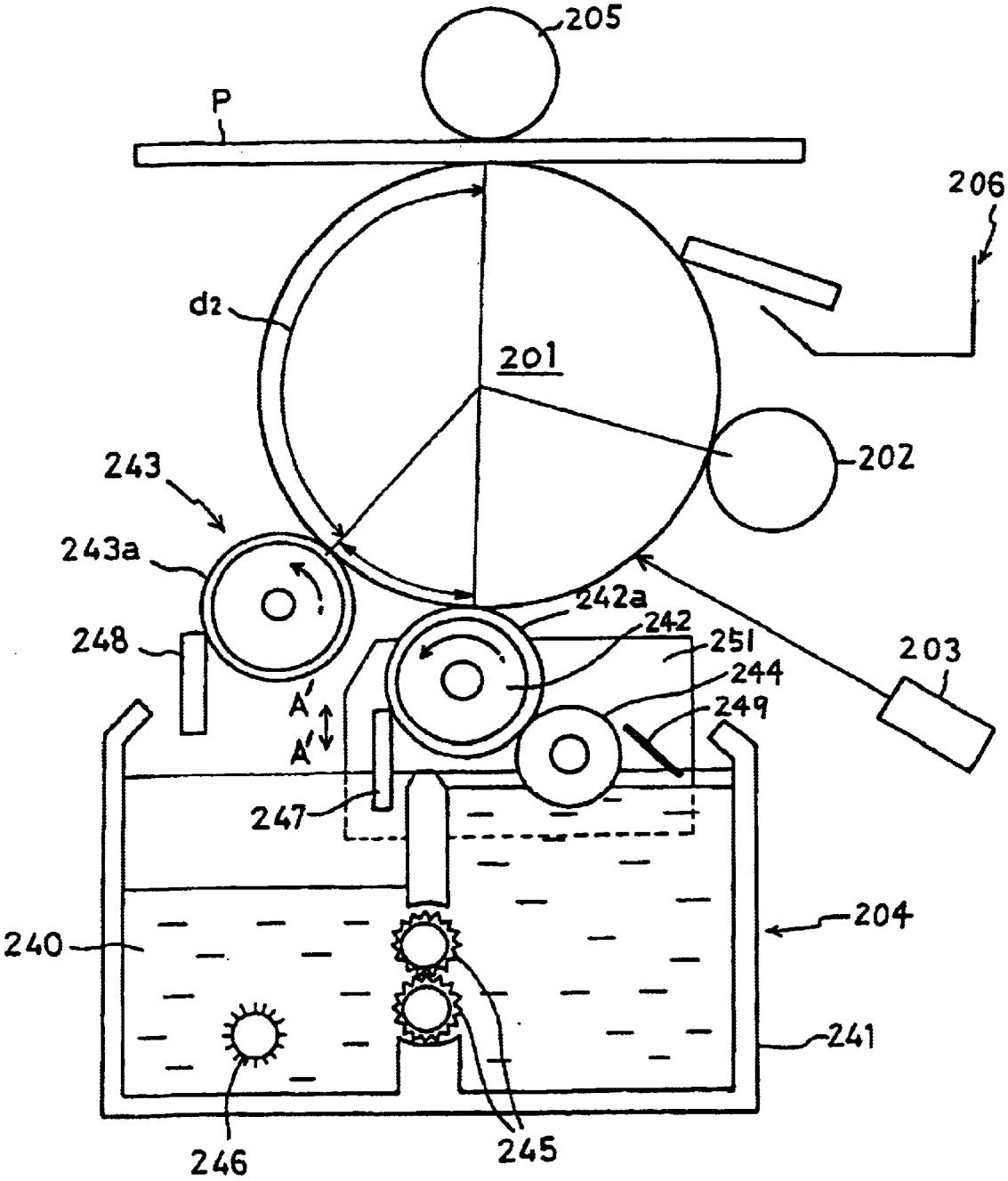
FIG. 7 is a cross-sectional view of the liquid developing device according to this invention and shows a contact state between the developing roller and the photoreceptor drum.

FIG. 7 is a schematic diagram showing a second embodiment of this invention in which the developing device according to this invention is applied to an electrophotographic copier as an example of the image formation apparatus.

In FIG. 7, the legend 201 represents the photoreceptor drum as a latent image carrier. There are the charger 202, developing roller 242, sweep roller 243, and the transfer device 205, which are successively disposed around the photoreceptor drum 201 in its rotating direction. The cleaning device 206 is disposed between the transfer device 205 and the charger 202, and the exposing device 203 is disposed between the charger 202 and the developing roller 242.

The developing roller 242 is brought into contact with the photoreceptor drum 201 with a predetermined pressure during use, and a prescribed nip width is formed between the photoreceptor drum 201 and the developing roller 242.

Although amorphous silicon is used here as a material of the photoreceptor drum 201, the material is not limited to the above one. However, by using the amorphous silicon with a high dielectric constant, an effective development electric field can be improved.

The developing roller 242 constitutes a part of the developing device 204. The outline of the electrophotographic copier will be explained first and the details of the developing device 204 will be explained later.

The photoreceptor drum 201 is driven to rotate in the direction of the arrow by the driving unit such as a motor not shown, and the surface of the photoreceptor drum 201 is uniformly charged to about 600 V by the charging roller 202 during rotation.

After the charging, when the charged portion of the photoreceptor drum 201 reaches an area where it faces the exposing device 203, the light for image formation is irradiated from the exposing device 203 to the charged area of the photoreceptor drum 201 to form an image, and an electrostatic latent image is formed on the photoreceptor drum 201.

Thereafter, the portion of the photoreceptor drum 201, where the electrostatic latent image has been formed, is developed while passing through the developing roller 242, toner adheres to the portion irradiated and image-formed with the image formation light to visualize the electrostatic latent image, and the toner image is formed on the surface of the photoreceptor drum 201.

Subsequently, the sweep roller 243 removes fogging toner and excess carrier liquid adhering to the background of the photoreceptor drum 201. After the removal, the developed portion of the photoreceptor drum 201 reaches the transfer position, and the transfer device 205 transfers the toner to a transfer paper P. The photoreceptor drum 201 shifts to the next copying cycle through removal of residual toner by the cleaning device 206 and removal of residual charges by the discharge lamp not shown. The transfer paper P is fixed by the fixing device not shown after the image is transferred and is ejected to the outside of the electrocopier.

Various types of transfer methods as follows can be used for the transfer device 205, such as a transfer method using an electrostatic roller, transfer method based on corona discharge, adhesive transfer method, or a thermal transfer method. Various types of systems as follows can be used for the fixing device, such as a thermal transfer system, solvent fixing system, or a pressuring and fixing system. Further, there is no need to directly transfer the image to the transfer paper P, thus any intermediate transfer body such as a transfer belt and a transfer roller may be used to transfer the image thereto.

The developing device 204 has a tank 241 for accommodation of developer, and the developer accommodation tank 241 stores developer 240. Liquid developer with low viscosity (about 1 cSt) and low concentration (about 1%) based on conventionally available Isopar (trademark of Exxon) as a carrier liquid is not used for the developer 240, but a highly viscous and highly concentrated liquid developer is desirably used.

As a range of the viscosity and concentration of the developer 240, for example, any developer having the viscosity within a range from 50 cSt to 5000 cSt and the concentration within a range from 5% to 40% is used. As a carrier liquid, any highly insulating liquid carrier such as silicone oil, normal paraffin, Isopar M (trademark: Exxon), vegetable oil, or mineral oil is used. The toner particles are dispersed in the carrier liquid. The toner particles range in size from submicrons to about 6 $\mu$m, and any particle size is selected in accordance with each purpose as required.

An agitating roller 246 and gear pumps 245 are disposed within the developer accommodation tank 241. A gravure roller (applying roller) 244 and a doctor blade 249 are disposed near the liquid level of the liquid developer 240 in the developer accommodation tank 241. Conductive elastic body layers 242*a* and 243*a* are provided around the outer circumferential surface of the developing roller 242 and sweep roller 243, respectively. For example, urethane rubber is used for the material forming the elastic body layers 242*a* and 243*a*, and desirably has JIS-A Standard rubber hardness of 50 degrees or below, but the hardness is not thus limited. Therefore, any material that has conductivity and does not swell by or dissolve in a solvent may be used. The sweep roller 243 is constructed to have a surface smoothness of 3 $\mu$m or below as the roughness Rz according to JIS Standard by coating the main body of the sweep roller or shielding it with a tube.

The liquid developer 240 is supplied to the developing roller 242 through the gravure roller 244 and is deposited thereon. During this processing, the amount of supply of the liquid developer to the developing roller 242 is regulated by the doctor blade 249.

A cleaning member 247 accompanies the developing roller 242, and a cleaning member 248 accompanies the sweep roller 243, and thereby the respective developer adhering to the developing roller 242 and sweep roller 243 is removed. Each of the cleaning members 247 and 248 here employs a blade system, but may employ a roller system.

Figure 8:
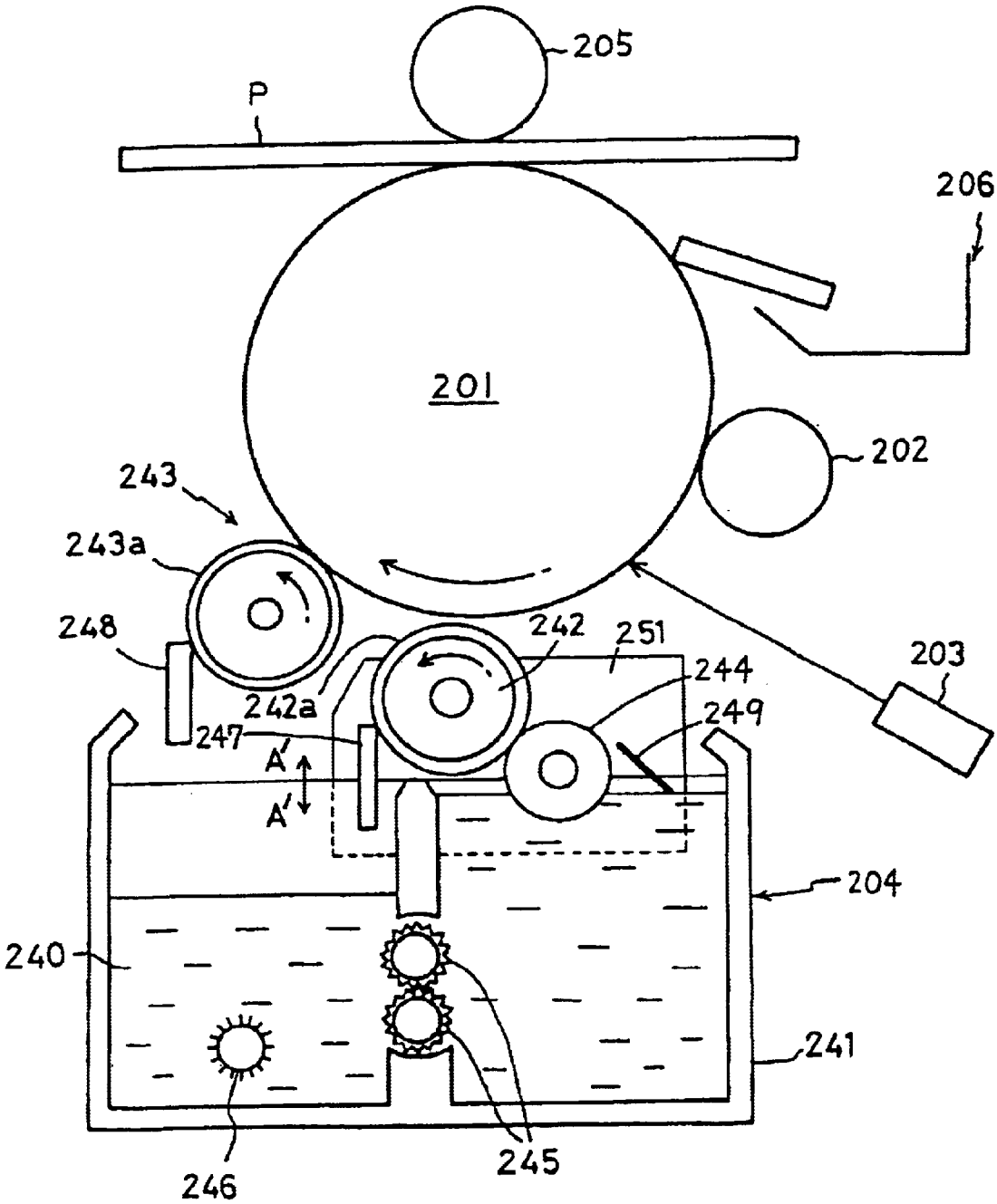
FIG. 8 is a cross-sectional view of the liquid developing device according to this invention and shows a separate state between the developing roller and the photoreceptor drum.

The developing roller 242, gravure roller 244, doctor blade 249, and the cleaning member 247 are born by a bracket 251, and the bracket 251 is brought upward and downward by a cum mechanism not shown, thereby the developing roller 242 can come into contact with or separate from the photoreceptor drum 201 in the directions of the arrows A'—A'. FIG. 8 shows a state where the developing roller 242 separates from the photoreceptor drum 201. Note that the developer accommodation tank 241 may be so constructed as to go up and down together with the developing roller 242.

When the developing device 204 is not in use, the developing roller 242 is separated from the photoreceptor drum 201. When the developing device 204 is in use, the photoreceptor drum 201 starts rotating, and when the developing roller 242 starts to approach the photoreceptor drum 201, the developing roller 242 is started to rotate. The peripheral velocity of the developing roller 242 is assumed the same as that of the photoreceptor drum 201. When the development of the photoreceptor drum 201 is finished and the developing roller 242 is to be separated from the photoreceptor drum 201, the peripheral velocity of the developing roller 242 is also the same as that of the photoreceptor drum 201.

As explained above, the peripheral velocity of these two is the same as each other immediately before the developing roller 242 comes into contact with the photoreceptor drum 201 and immediately before the developing roller 242 separates from the photoreceptor drum 201, and it is therefore possible to prevent scratches or damages on the two surfaces caused by being rubbed against each other.

A layer of the developer in which toner particles are dispersed is formed on the surface of the developing roller 242 before the developing roller 242 comes into contact with the photoreceptor drum 201. Further, when the developing roller 242 is to separate from the photoreceptor drum 201, the layer of the liquid developer 240 containing toner dispersed is formed.

If the layer of the liquid developer 240 with the toner dispersed is not formed on the surface of the developing roller 242 and there is a potential difference between the photoreceptor drum 201 and the developing roller 242, abnormal spark discharge is produced at the time of contact, and the surface of the photoreceptor layer and the surface of the developing roller are damaged. However, by controlling the developing roller 242 so that the layer of the liquid developer 240 is formed immediately before the developing roller 242 is brought into contact with the photoreceptor drum 201 or immediately before the developing roller 242 is separated from the photoreceptor drum 201, the liquid developer 240 can function as an electrically insulated layer, thus preventing spark discharge.

A predetermined potential is applied to the surface of the photoreceptor drum 201 so that the toner does not move from the developing roller 242 to the photoreceptor drum 201 immediately before the developing roller 242 is brought into contact with the photoreceptor drum 201 or immediately after the developing roller 242 is separated from the photoreceptor drum 201.

For example, a potential (including 0V) corresponding to the condition of the non-image portion is applied to the surface of the photoreceptor drum 201. Whereby waste of toner can be prevented when the developing roller 242 is in contact with or is separated from the photoreceptor drum 201.

Assuming that the surface of the photoreceptor drum 201 is not in a condition for the non-image portion, when the developing roller 242 comes into contact with the photoreceptor drum 201 or separates from the photoreceptor drum 201, unnecessary toner movement occurs from the developing roller 242 to the photoreceptor drum 201 in any other part except the image formation area, and toner is therefore wasted. However, in accordance with the embodiment of this invention, a predetermined potential is applied to the surface of the photoreceptor drum 201 so that the toner does not move from the developing roller 242 to the photoreceptor drum 201 immediately before the developing roller 242 is brought into contact with the photoreceptor drum 201 or immediately after the developing roller 242 is separated from the photoreceptor drum 201. Thereby the surface of the photoreceptor drum 201 satisfies the condition for the non-image portion, which makes it possible to prevent the toner from its waste.

That is, in the embodiment of this invention, the photoreceptor drum 201 and the developing roller 242 are controlled to be rotated so that their peripheral velocity is the same as each other immediately before the developing roller 242 and the photoreceptor drum 201 come into contact with each other. The surface of the photoreceptor drum 201 is charged to satisfy the condition required for the non-image portion, the layer of the liquid developer 240 is formed on the developing roller 242, the photoreceptor drum 201 and the developing roller 242 then contact each other, an electrostatic latent image is formed on the photoreceptor drum 201, and the image is developed and transferred.

After the copying is finished, the photoreceptor drum 201 and the developing roller 242 are controlled so that these two are separated while being rotated. The photoreceptor drum 201 is discharged immediately after the developing roller 242 is separated from the photoreceptor drum 201, and the rotation of the photoreceptor drum 201 is stopped. On the other hand, a film layer of the liquid developer 240 is formed on the developing roller 242 and its rotation is stopped, and the developing roller 242 is in a standby state for the next development while keeping this state.

In this embodiment, $d1/V<0.5$ is obtained, where a distance from the developing roller 242 to the sweep roller 243 in the rotating direction of the photoreceptor drum 201 is d1 and a linear velocity (peripheral velocity) of the photoreceptor drum 201 is v.

Wherein the unit of the distance dl in the rotating direction is mm and the unit of the linear velocity v of the photoreceptor drum 201 is mm/sec.

$d2/V<0.7$ is obtained, where a distance from the sweep roller 243 to the transfer position of the transfer device 205 in the rotating direction of the photoreceptor drum 201 is d2.

This is because when the toner image formed on the surface of the photoreceptor drum 201 passes through the sweep roller 243, the image quality is prevented from being degraded due to distortion that may occur at the time of transfer of the toner image to the transfer paper P by the transfer device 205.

Figure 9B:
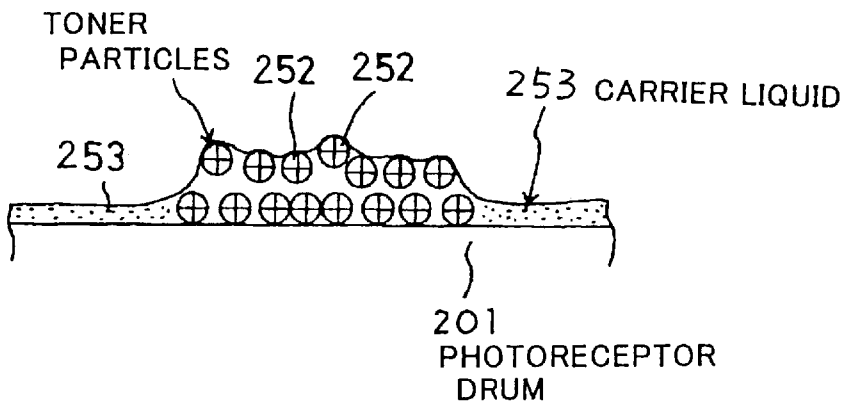
FIG. 9A and FIG. 9B each show an alignment state of toner adhering to an area of an electrostatic latent image of the photoreceptor drum.
Figure 9A:
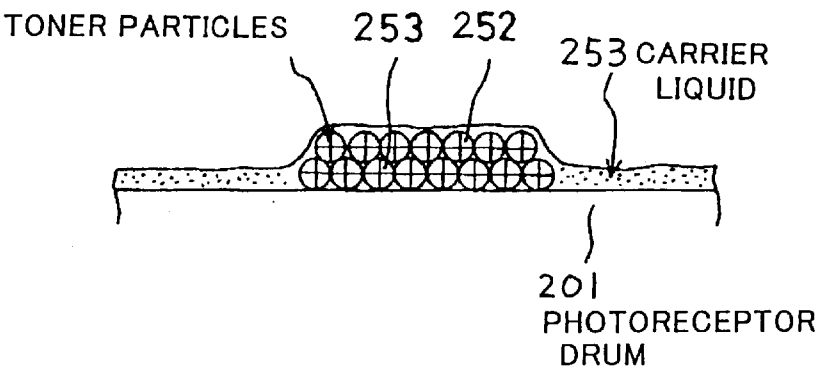

That is, the toner particles 252 adhering to the surface of the photoreceptor drum 201 align as shown in FIG. 9A immediately after being developed. This alignment occurs due to Coulomb attractive force between the charges of the photoreceptor drum 201 and the toner particles 252, and due to the image force (attractive force) produced through formation of a mirror image of the toner particles 252 on the photoreceptor drum 201. However, Coulomb repulsive force acts between the toner particles 252. In particular, the Coulomb repulsive force is dominant in the toner particles 252 on the top layer forming fine dots and fine lines, the Coulomb attractive force is scattered and moved in the carrier liquid 253 with the passage of time. And, as schematically shown in FIG. 9B, the toner particles 252 are fluctuated and thereby the toner image is distorted.

If the toner image passes through the sweep roller 243 in this distorted state, this distortion is further worsened, and the image quality is degraded. Further, distortion occurs by the time the toner image moves from the sweep roller 243 to the transfer device 205, and thereby the image quality is degraded.

Figure 10:
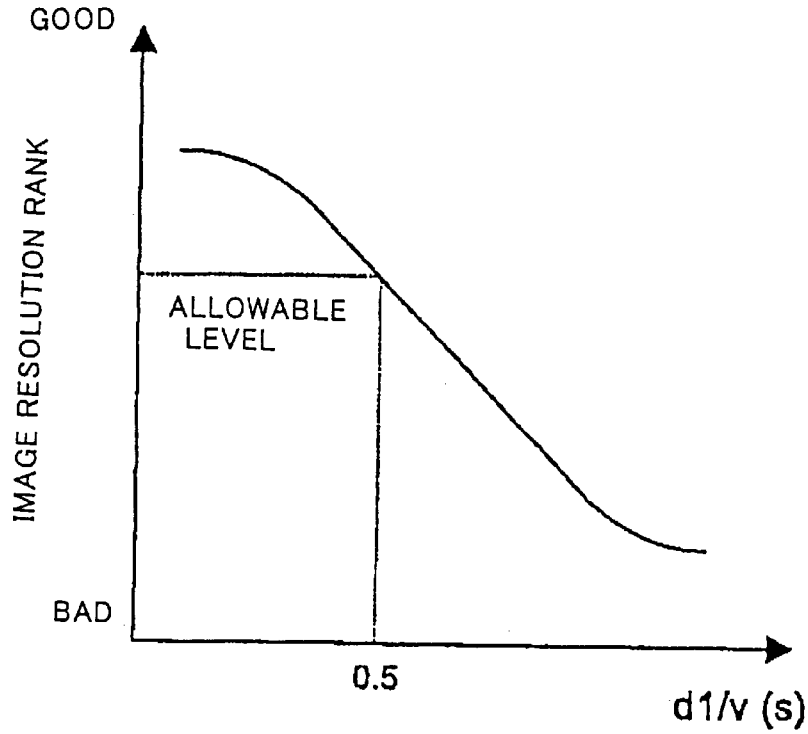
FIG. 10 shows a characteristic curve of image deterioration time between a time required from when a toner image passes through the developing roller until it reaches the sweep roller, and deterioration in the toner image.

To solve the degradation, the inventor of this invention carried out experiments under the conditions explained below to obtain an image degradation-time characteristic curve indicating a relation between a passing time from when the toner image passed through the developing roller 242 until it reached the sweep roller 243, and degradation of the toner image, as shown in FIG. 10. The inventor also obtained an image degradation-time characteristic curve indicating a relation between a passing time from when the toner image passed through the sweep roller 243 until it reached the transfer position of the transfer device 205, and degradation of the toner image.

As understood from the result of the experiments shown in FIG. 10, if the passing time of the toner image from the developing roller 242 to the sweep roller 243 is within 0.5 sec, an allowable level of image quality can be maintained.

The reason is considered because the electric field may be applied again to the toner particles 252 before they are dispersed and moved by the Coulomb repulsive force to compress the toner layer.

Figure 11:
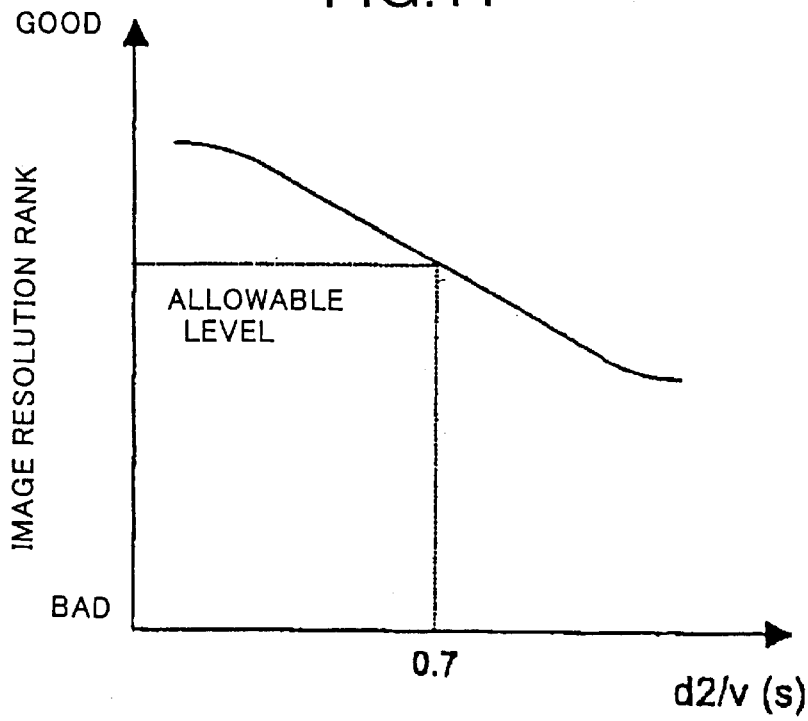
FIG. 11 shows a characteristic curve of image deterioration time between the time required from when toner passes through the sweep roller until it reaches a transfer position of a transfer device, and deterioration in the toner image.

As understood from the result of the experiments shown in FIG. 11, if its passing time from the sweep roller 243 to the transfer position is within 0.7 sec, an allowable level of image quality can be maintained.

The image degradation-time characteristic curve shown in FIG. 11 has a smooth slope as compared to the image degradation-time characteristic curve shown in FIG. 10. Further, the passing time of the toner image from the sweep roller 243 to the transfer position is within 0.7 sec, which may be sufficient. The reason can be considered because the excess carrier liquid 253 on the photoreceptor drum 201 is removed, the amount of the carrier liquid 253 on the photoreceptor drum 201 is reduced, and thereby the movement and dispersion of the toner particles 252 are suppressed.

Experimental Conditions

Average particle size of toner . . . 4 μm

Layer thickness of the toner liquid developer (carrier liquid 253) on the photoreceptor drum 201 . . . 8 μm Viscosity of the carrier liquid 253 . . . 100 cSt Charged amount of toner 52 . . . 150 uc/g Photoreceptor drum 201 . . . Amorphous silicon photoreceptor Surface potential of the photoreceptor drum 201 . . . 600 V An example of a third embodiment when this invention is applied to an electrophotographic image formation apparatus (hereafter called "image formation apparatus") as a liquid image formation apparatus will be explained below. FIG. 12 to FIG. 15 each schematically show the key section of the image formation apparatus according to the third embodiment. The image formation apparatus according to the third embodiment comprises the charger 302, exposing device 303, developing device 304, transfer device 305, and the cleaning device 306, which are disposed around the photoreceptor drum 301 as a latent image carrier. The photoreceptor drum 301 may use, e.g., a-Si or OPC as its material. The exposing device 303 may use, e.g., LED or laser optics.

The case where an image is formed by reversal development in the above constructed image formation apparatus will be explained below. The photoreceptor drum 301 is driven to rotate in the direction of the arrow at a constant speed by the driving unit such as a motor not shown during copying. The charging roller, not shown, of the charger 302 uniformly charges the photoreceptor drum 301 to about 600 V in the dark. An image of a document is then irradiated with light and image-formed by the exposing device 303, and an electrostatic latent image is carried on the outer circumferential surface of the photoreceptor drum 301.

Thereafter, the electrostatic latent image is developed during passing through the developing device 304. The toner image developed to the electrostatic latent image is transferred to transfer paper by the transfer device 305. After the transfer paper is separated, residual toner is removed from the photoreceptor drum 301 by the cleaning device 306. Subsequently, residual potential on the surface of the photoreceptor drum 301 is removed by the discharge lamp not shown, and the drum 301 is in a standby state for next copying. The transfer paper to which the toner image is transferred passes through a fixing device not shown to be ejected to the outside of the machine. The transfer device 305 may use any of transfer methods such as a method using an electrostatic roller (which comprises the transfer roller 307 or a transfer belt that is not shown in FIGS. 12–15), method based on corona discharge, adhesive transfer method, or a thermal transfer method. The fixing device may use any of systems such as a thermal transfer system, solvent fixing system, or a pressuring and fixing system.

The developer 340 used in the image formation apparatus of the third embodiment is not the liquid developer of low viscosity (about 1 cSt) and low concentration (about 1%) based on conventionally available Isopar (trademark of Exxon) as a carrier, but is a highly viscous and highly concentrated liquid developer. The developer 340 to be used is any developer having a viscosity within a range from 50 cSt to 5000 cSt and a concentration within a range from 5% to 40%. The carrier liquid to be used is any of highly insulating liquid carriers such as silicone oil, normal paraffin, Isopar M (trademark: Exxon), vegetable oil, or mineral oil. It is possible to select volatility or non-volatility for any purpose. The toner particles range in size from submicrons to about 6 μm, and any particle size can be selected in accordance with each purpose.

Figure 12:
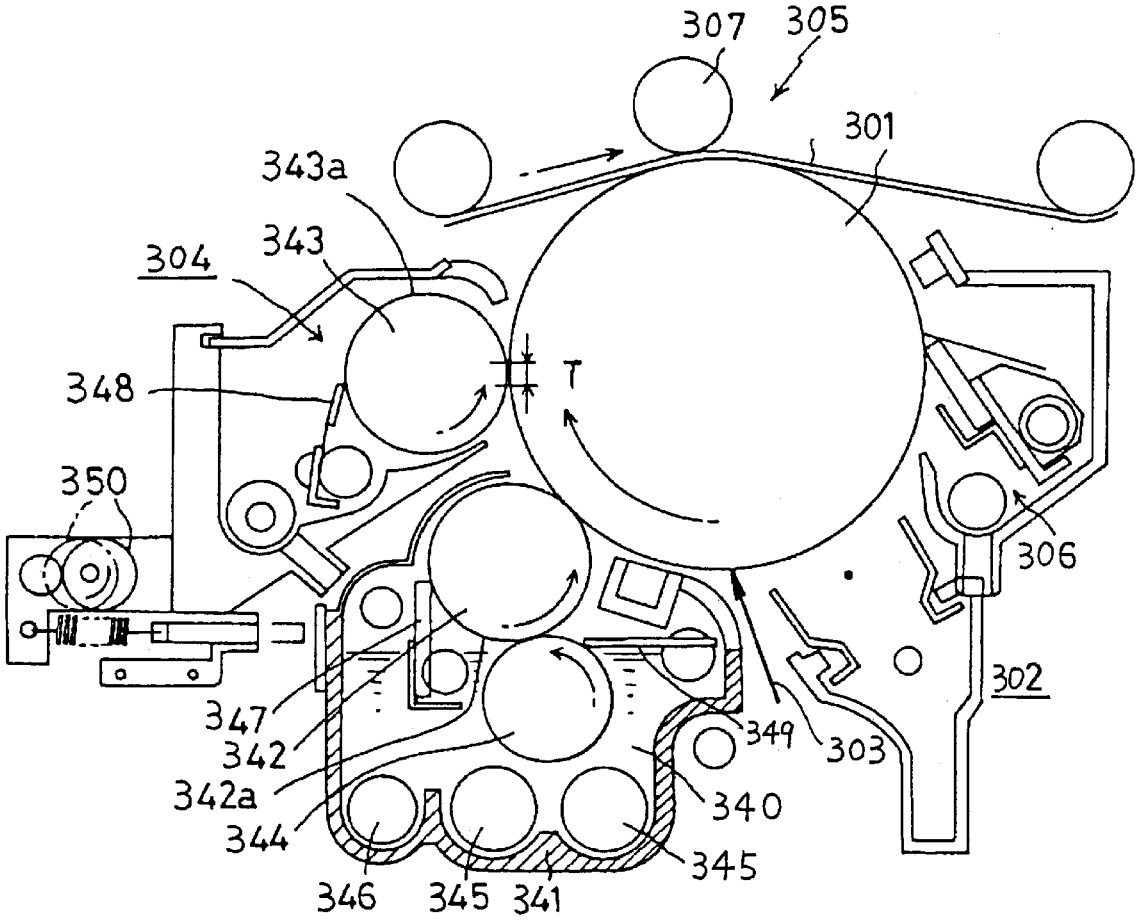
FIG. 12 is a cross-sectional front view of the liquid image formation apparatus according to an embodiment of this invention.

The developing device 304 as characteristics of the third embodiment will be explained below. As shown in FIG. 12, the developing device 304 has main components such as the developer accommodation tank 341 that accommodates the developer 340 inside the tank, developing roller 342, sweep roller 343, gravure roller 344 as an applying unit, gear pumps 345, and the agitating roller 346. The developing roller 342 and sweep roller 343 are provided with respective cleaning members 347 and 348 each formed of a metal blade or a rubber blade. The cleaning members 347 and 348 are not necessarily the blade but may employ a roller system. Further, the gravure roller 344 is provided with the doctor blade 349.

The developing roller 342 and sweep roller 343 have respective elastic body layers 342*a* and 343*a* each having conductivity provided around their outer circumferential surfaces. Urethane rubber can be used for the material of the elastic body layers 342*a* and 343*a*. The elastic body layers 342*a* and 343*a* desirably have JIS-A Standard rubber hardness of 50 degrees or below. The material of the elastic body layers 342*a* and 343*a* is not limited to the urethane rubber, but any material that has conductivity and does not swell by or dissolve in a solvent may be used. The elastic body layer may be provided not on the developing roller 342 and the sweep roller 343 but on the photoreceptor drum 301.

Although the photoreceptor is formed here with a drum, it may be formed of an endless belt-like member. The sweep roller 243 is constructed to have a surface smoothness of Rz 3 μm or below by being coated or using a tube.

When the developing roller 342 and sweep roller 343 are brought into contact with the photoreceptor drum 301 with respective adequate pressure, the elastic body layers 342*a* and 343*a* of the rollers are elastically deformed to form a developing nip and a sweep nip, respectively. Particularly, by forming the developing nip, it is possible to ensure a predetermined developing time required for movement of the toner in the developer 340 toward the photoreceptor drum 301 and adhere the toner thereto by the development electric field in the development area. Further, by adjusting a contact pressure, a nip width as a size in the surface moving direction at each nip can be adjusted. Each of the nip widths is set to a value not less than a product of the linear velocity of each roller and development time constant. The development time constant mentioned here indicates a time required by the time when the development amount is saturated, and is a value obtained by dividing the nip width by a process speed. For example, when the nip width is 3 mm and the process speed is 300 mm/sec, the development time constant becomes 10 msec.

A thin layer of the developer 340 is formed on the developing roller 342 by the gravure roller 344 during development. The thickness of the developer 340 applied to the developing roller 342 at this time was set to a value so that a pigment content in the toner carried on the surface per square cm would be within a range from 0.1 μg to 2 μg. To realize this, the developer 340 was applied to form a thin layer with a thickness of 5 to 10 μm. The reason is because when the thickness of the developer 340 applied is such that the pigment content in the toner carried on the surface of the developing roller 342 per square cm is smaller than 0.1 μg, a sufficient amount of pigment is apt to fail to migrate toward the image portion for the latent image formed on the photoreceptor drum 301. Accordingly, the image density of the image portion may become low. Further, when the thickness is such that the pigment content in the toner carried on the surface of the developing roller 342 per square cm is larger than 2 μg, a large amount of excess toner remains on the background after development, and thereby imperfect removal of the toner may be performed by the sweep roller 343.

The thin layer of the developer 340 formed on the surface of the developing roller 342 passes through the developing nip formed with the photoreceptor drum 301 and the developing roller 342. In the electrophotographic developing device 304 in general, the surface moving speed of the developing roller 342 is set slightly higher than that of the photoreceptor drum 301, so that a sufficient amount of toner can be fed to an area where the photoreceptor drum 301 and the developing device 304 face each other. This, however, causes toner to move at a high speed relative to the surface of the photoreceptor drum 301 and thereby brings about positional displacement between the toner and the latent image. Consequently, an image is sometimes blurred at the leading edge portion or sometimes has an imbalance between vertical lines and horizontal lines. This phenomenon is also true for development using a liquid developer. The image formation apparatus according to the third embodiment is free from the above-explained phenomena because the surface of the developing roller 342 and that of the photoreceptor drum 301 move at substantially the same speed and inhibit the toner from having a relative velocity vector in the tangential direction of the photoreceptor drum 301.

Figure 20A:
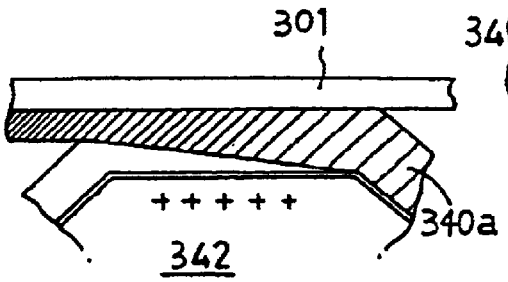
FIG. 20A and FIG. 20B each show a state of the developer at a nip for sweep formed with the photoreceptor and the developing roller.
Figure 20B:
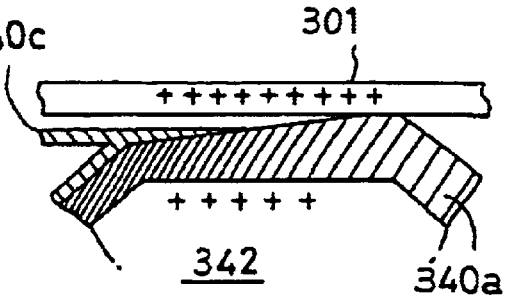

A bias voltage for development (400 V) lower than the surface potential of the photoreceptor drum 301 (600 V) is applied to the developing roller 342 and a development electric field is produced between the developing roller 342 and the image surface whose potential has been lowered to 50 V or below by the exposing device 303. FIG. 20A and FIG. 20B each schematically show a state of the developer 340 at the developing nip. As shown in FIG. 20A, in the image portion of the photoreceptor drum 301, the toner 340*a* in the developer 340 moves to the photoreceptor drum 301 by the electric field to visualize a latent image. On the other hand, in the background (non-image portion), as shown in FIG. 20B, the toner 340*a* is moved to the surface of the developing roller 342 due to the electric field formed by the developing bias potential and the potential of the photoreceptor drum 301 so as to prevent the toner 340*a* from adhering to the background portion.

Figure 21A:
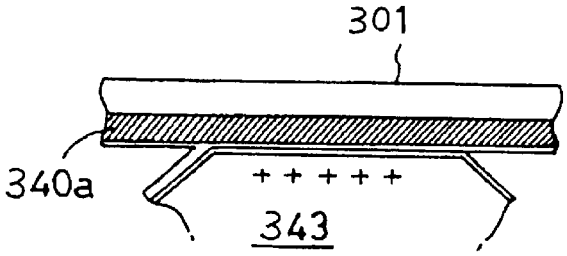
FIG. 21A and FIG. 21B each show a state of the developer at the sweep nip formed with the photoreceptor and the sweep roller.
Figure 21B:
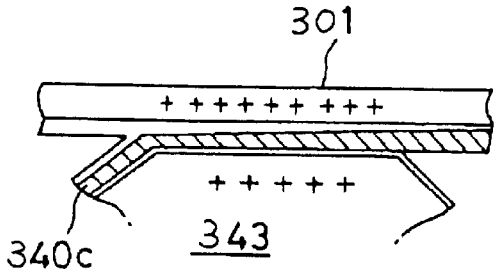

However, if part of the toner 340*a* on the background fails to migrate toward the surface of the developing roller 342 and remains on the photoreceptor drum 301, this portion may cause a fog. Therefore, the developing device 304 of the image formation apparatus according to the third embodiment is provided with the sweep roller 343 in order to sweep the toner 340*c* which causes the fog (hereafter called "fogging toner"). This sweep roller 343 is disposed on the downstream side in the direction of rotating the photoreceptor drum 1 with respect to the developing roller 342 by being pressed against the photoreceptor drum 301 so that the developed toner layer is sandwiched by these two. The surface of the sweep roller 343 moves at substantially the same speed as the surface of the photoreceptor drum 301. FIG. 21A and FIG. 21B each schematically show a state of the developer at the sweep nip formed with the photoreceptor drum 301 and the sweep roller 343.

A bias voltage (250 V) close to the surface potential (100 to 200 V) of the toner layer on the photoreceptor drum 301 is applied to the sweep roller 110 so as to prevent the toner 340*a* from returning from the toner layer after development to the sweep roller 343. On the background, as shown in FIG. 21B, the stray fogging toner 340*c* is moved to the sweep roller 343 by the electric field produced by a difference between the potential at the background of the photoreceptor drum 301 and the potential based on the bias voltage. The developer layer of the background in this stage is about one-half of the thickness of the developing nip part in the developing roller 342 and the toner concentration lowers to about 20% of the concentration before development. Thus, the fogging toner 340*c* can be easily removed. Accordingly, the fog on the background can be fully prevented. A relation of the potentials can be indicated as follows.

That is, the relation is: photoreceptor potential>VB1>VB2> toner layer potential, where VB1 is a potential between the photoreceptor drum 301 and the developing roller 342, and VB2 is a potential between the photoreceptor drum 301 and the sweep roller 343.

By providing the sweep roller 343, the excess carrier liquid adhering to the background of the photoreceptor drum 301 can be removed by about one-half of it during development.

Further, the sweep roller 343 can efficiently remove the fogging toner 340*c*. Therefore, a slight amount of the fogging toner 340*c* may be allowed to remain in the developing nip between the photoreceptor drum 301 and the developing roller 342, and thereby the fog removal electric field (a potential difference between the developing bias applied to the developing roller 342 and a charge potential on the photoreceptor drum 301) can be suppressed to a minimum. Accordingly, the charge potential of the photoreceptor drum 301 can be lowered. Thus, various advantages as follows are attained: enhancement in durability of the photoreceptor drum 301, reduction in load to the charging roller 302, and reduction in power for exposure.

In the image forming method as explained referring to the background art, it is possible to simultaneously perform development of an image and removal of fogging toner on the background by the developer carrier. However, it is required to ensure a comparatively longer developing time (e.g., about 40 msec), and it is therefore required to widen a developing nip width to be formed between the latent image carrier and the developer carrier. In this conventional image forming method, the developer carrier having an elastic layer is brought into contact with the latent image carrier to form a nip part. Therefore, in order to make the developing nip width wider, the contact pressure tends to be increased. On the other hand, the developing device 304 for the image formation apparatus according to the third embodiment is provided with the sweep roller 343, which makes it possible for the developing roller 342 to separate the function of development from the function of removal of the fogging toner 340*c*. Thereby the developing nip width can be smaller as compared to the width based on the conventional device and the contact pressure can be reduced (to e.g., 0.3 kgf/mm or below). Accordingly, it is possible to reduce the load on the photoreceptor drum 301, developing roller 342, and the sweep roller 343, and to enhance durability.

In the third embodiment, although the case where an image is formed by reversal development has been explained, the image can also be formed by normal development. When the image is formed based on the normal development, in the image formation apparatus constructed as explained above, a relation between potentials is set as follows.

That is, the relation is: photoreceptor potential>toner layer potential ≧VB2>VB1>non-image portion potential, where VB1 is a potential between the photoreceptor drum 301 and the developing roller 342, and VB2 is a potential between the photoreceptor drum 301 and the sweep roller 343.

As an example of specific potentials, the photoreceptor potential is set to 600 V, toner layer potential to 200 to 300 V, VB2 to 200 V, VB1 to 100 V, and the non-image portion potential is to 50 V.

Figure 17:
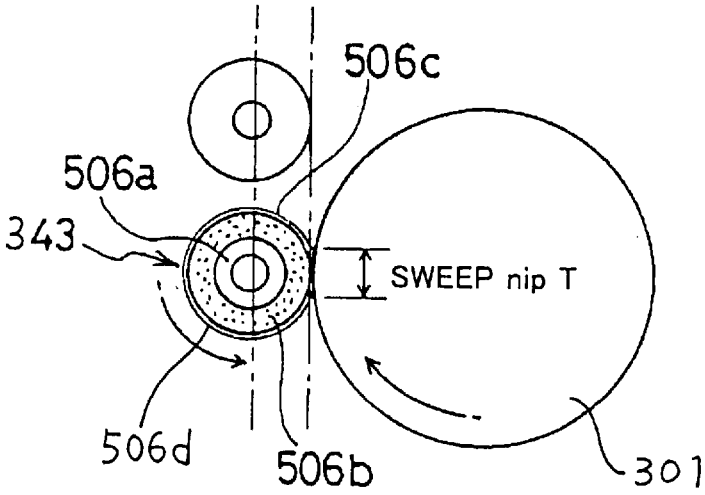
FIG. 17 shows a state of how the sweep roller is pressed against the photoreceptor by a bumping roller of the apparatus shown in FIGS. 12 to 16.

The sweep roller 343 has substantially the same length as the width of an image formed on the photoreceptor drum 301. As shown in FIG. 17, the sweep roller 343 has the core metal 506*a* formed of a rigid body such as stainless steel, elastic sweep roller body 506*b* formed around the periphery of the core metal 506*a*, and the surface film layer 506*d* formed on the surface of the sweep roller body 506*b*. The legend 506*c* represents the surface of the sweep roller 343. The elastic member forming the sweep roller body 506*b* includes any foam formed of polystyrene, polyethylene, polyurethane, poly (vinyl chloride) or NBR (nitryl butylene rubber), or a low-hardness rubber member such as silicone rubber and urethane rubber. The surface layer 506*d* of the sweep roller is formed of a conductive member, such as a urethane rubber member, that does not swell by silicone oil as carrier liquid of liquid developer explained later. When a sweep voltage is applied to the surface from the core metal 506*a* of the sweep roller 343, the electrical resistivity of the sweep roller 343 is desirably $10^9$ ohms or below and the sweep roller 343 is desirably formed of a synthetic rubber base binder in which conductive particles such as carbon black are dispersed and with a conductive film layer. The sweep voltage is applied to the surface by pressing a leaf spring such as a phosphorus bronze plate against the end face of the core metal 506*a* and coming into contact with the end face. Although the bias applying unit of the sweep roller 343 in particular has been explained using the leaf plate, this embodiment is not limited by this plate.

Further, there is a case where a desired resistance cannot be obtained in the elastic body because the conductive elastic body has conductive particles such as carbon black that are dispersed in the body and thereby its hardness is in many cases increased. In this case, it is desirable that the sweep roller surface layer 506*d* is formed and its volume resistivity is $10^9$ ohms-cm or below. A sweep bias in this case may be applied by directly contacting the electrode with the surface of the sweep roller 343. The sweep bias was applied by pressing the leaf plate such as a phosphorus bronze plate against the surface of the sweep roller 343 so as to bring the plate into contact with the surface. As a sweep bias applying unit, a conductive cleaning blade may be used for the dual purpose. Although the bias applying unit of the sweep roller in particular has been explained using the leaf plate, this embodiment is not limited by this plate.

The method of forming the surface layer 506*d* on the surface of the sweep roller body 506*b* includes, for example, a method of coating the surface of the sweep roller body 506*b* with a synthetic rubber base binder in which the conductive particles such as carbon black are dispersed, and a method of shielding the sweep roller body 506*b* with a heat-shrinkable tube having conductivity and heating the tube to be shrunk. Alternatively, the sweep roller body 506*b* maybe formed inside the surface layer 506*d* by injecting an elastic material into the internal part of the conductive tube or foaming the injected elastic material. As the tube having conductivity, a resin tube formed of polyimide, polycarbonate, or nylon, or a metal tube formed of nickel is used. As the heat-shrinkable tube having conductivity, a resin tube formed of PFA or PTFE is used. Particularly, the PFA and PTFE tubes whose volume resistivity is about $10^9$ ohms-cm, required for preventing the developer from adhering to the sweep roller, exhibited excellent effects. Further, by forming the surface layer 506*d* on the sweep roller 343, impregnation of the elastic material with the carrier liquid and increase in the hardness of the material due to addition of the conductive additive could be suppressed. These tubes are desirably so called an endless tube that is seamless. Note that the sweep roller body 506*b* may be formed of an elastic member such as urethane rubber that does not swell by silicone oil. In this case, there is no need to form the surface layer 506*d* on the surface of the sweep roller body 506*b*. However, in order to allow an electric developing bias to be applied to the sweep roller 343, it is necessary to set an electrical resistivity to a desired value by performing conductive process on the surface of the sweep roller body 506*b* or adding conductive particles to the elastic member that forms the sweep roller body 506*b*.

Figure 18:
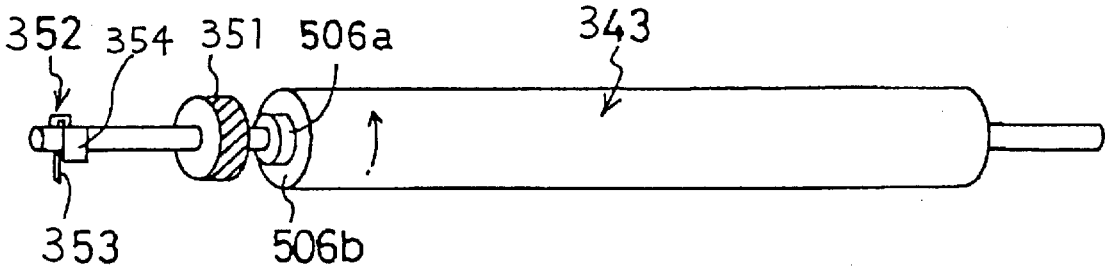
FIG. 18 shows a modified example of the sweep roller according to this invention.
Figure 19:
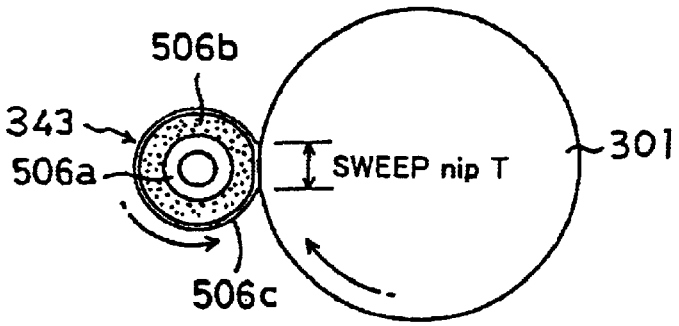
FIG. 19 shows a state of how the sweep roller as the modified example shown in FIG. 18 is pressed against the photoreceptor.

The sweep roller 343 is disposed so as to come into contact with the photoreceptor drum 301, and rotates in the direction opposite to the rotating direction of the photoreceptor drum 301, that is, in the direction in which the sweep roller 343 follows the photoreceptor drum 301. The sweep roller 343 has a nip width T formed in the development area through elastic deformation produced by a pressuring force of the sweep roller 343 against the photoreceptor drum 301. The hardness of the sweep roller 343 is desirably 50 degrees or below according to JIS-A Standard, and the sufficient result was obtained when it was 30 degrees or below according to JIS-A standard. When the JIS-A hardness is 50 degrees or above, the surface is too hard. Therefore, it is impossible to realize an optimal nip and pressure required for bringing the sweep roller 343 into contact with the photoreceptor drum 301 while maintaining the liquid developer layer on the sweep roller 343 and the image on the photoreceptor drum 301. The hardness of the sweep roller is determined based on a diameter of the photoreceptor drum 301 and a diameter of the sweep roller to obtain a desired nip, which will be explained later. The sweep roller needs to be disposed so as to form a fine gap between the sweep roller and the photoreceptor drum 301. This makes it difficult to install the sweep roller. The nip width T produced in the sweep roller by its elastic deformation is set based on a relation between the capacitance formed with the developing roller, developer layer and the photoreceptor drum 301, and the development time constant defined by an electric circuit including a resistance component. The pressure of the sweep roller against the photoreceptor drum 301 was adjusted by disposing bumping rollers 507, which come into contact with the photoreceptor drum 301, on both ends of the sweep roller 343 and exchanging these rollers 507 with those having a different outer diameter. When the elastic material of the sweep roller 343 is a solid and the film tube on its surface is greater than 100 $\mu$m, sufficient elasticity cannot be obtained, and 100 μm or below is therefore required. Further, when the outer diameter of the sweep roller 343 is 24 ϕ, an excellent effect is obtained in a 70-μm film layer. The bumping rollers may not be disposed as shown in FIG. 18. FIG. 19 shows a state of how the sweep roller 343 presses against the photoreceptor drum 301 in that case.

When the elastic material of the sweep roller 343 is a foam, an average pore diameter is desirably 300 μm or below, and the thickness of the film tube is desirably 10 to 70 μm because the pores are visible in an image when the thickness is 10 μm or below.

By bringing the developing roller 342 and the sweep roller 343 into contact with the photoreceptor drum 301 with respective adequate pressure, the elastic body layers 342*a* and 343*a* of the rollers are elastically deformed to form a developing nip and a sweep nip, respectively. Particularly, formation of the developing nip enables insurance of a predetermined developing time required for movement of the toner in the developer 340 to the photoreceptor drum 301 and adhere the toner thereto by the development electric field in the development area. Further, by adjusting a contact pressure, a nip width as a size in the surface moving direction in each nip part can be adjusted. Each of the nip widths is set to a value not less than a product of the linear velocity of each roller and development time constant. The development time constant mentioned here indicates a time required by the time when the development amount is saturated, and is a value obtained by dividing the nip width by a process speed. For example, when the nip width is 3 mm and the process speed is 300 mm/sec, the development time constant becomes 10 msec.

The developing roller 342 and sweep roller 343 have respective conductive elastic body layers 342*a* and 343*a* provided around their outer circumferential surfaces. Urethane rubber can be used for the material of the elastic body layers 342*a* and 343*a*. The elastic body layers 342*a* and 343*a* desirably have JIS-A Standard rubber hardness of 50 degrees or below. The material of the elastic body layers 342*a* and 343*a* is not limited to the urethane rubber, but any material that has conductivity and does not swell by or dissolve in a solvent maybe used. The elastic body layer may be provided not on the developing roller 342 and the sweep roller 343 but on the side of the photoreceptor drum 301.

The photoreceptor may be formed of an endless belt-like member. The sweep roller 243 is constructed to have a surface smoothness of Rz 3 μm or below by being coated or using a tube.

As shown in the figure, the sweep roller unit comprises the sweep roller, cleaning blade, removed-developer flow passage, removed-developer conveying screw, and the electrode for applying a voltage to the sweep roller. The sweep roller unit is obtained by integrating the sweep roller and cleaning blade into one unit with a holding member, and the holding member has the removed-developer flow passage and the removed-developer conveying screw. A driving gear is disposed in the end of the core metal of the sweep roller.

The developing device of this invention develops an electrostatic latent image formed on the photoreceptor drum 301 in the developer thin layer formed on the developing roller 342 to recover the excess fogging toner and carrier liquid. The not-yet-used developer in the developer thin layer, that has not been used for development, remaining on the developing roller 342 during the process of developing is recovered by the cleaning blade 347, the excess fogging toner and carrier liquid on the photoreceptor drum 301 are removed by the sweep roller 343, and the removed developer is recovered by the cleaning blade. The respectively recovered developer is collected by a conveying unit not shown, such as a screw. Further, the image on the photoreceptor drum 301 explained later is transferred to the transfer body or a recording body, and the developer remaining after being transferred on the photoreceptor drum 301 is also recovered and collected. The collected developer is subjected to recycle processing not shown, and is used again as a developer in the developing process. With regard to recycle of the developer, a recyclable developer is required differently depending on the monochrome image formation apparatus, full-color image formation apparatus, and the construction of the apparatus. Only an example is explained in this embodiment, and the developer is not therefore limited by the above developer.

The processing for recycling includes concentration adjustment and re-dispersion of toner particles, or the like.

Figure 16A:
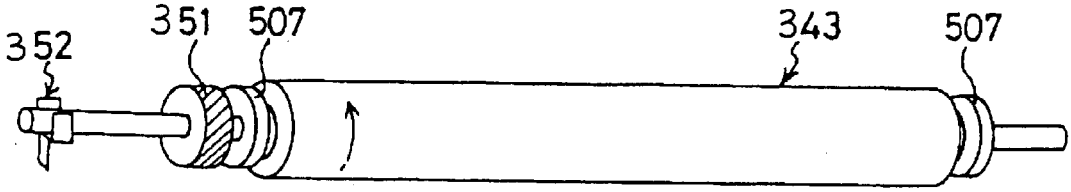
FIG. 16A to FIG. 16E are views each for explaining the sweep roller of the apparatus shown in FIGS. 12 to 15.
Figure 16B:
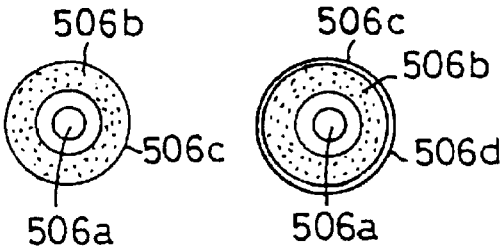
Figure 16C:
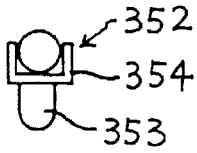
Figure 16D:
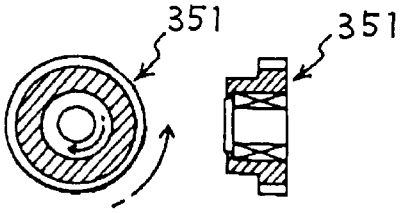
Figure 16E:
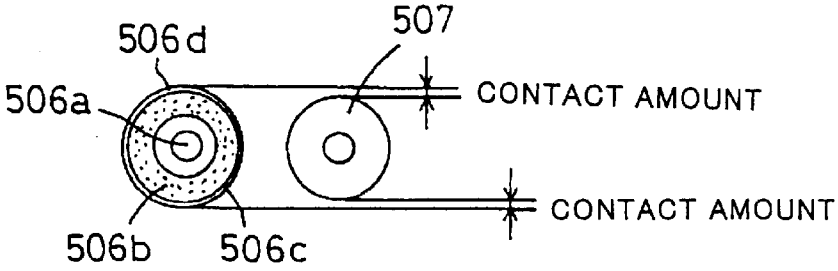

As shown in FIG. 16C, the electrode 352 of a sweep voltage is formed with an electrode composed of the leaf plate as a biasing member and an electrode protrusion 353 formed of a bronze material capable of wearing disposed therein, and is provided in the end face of the core metal 506*a*. By providing the bronze material capable of wearing in the leaf plate 354 to obtain the electrode 352, a contact point between the core metal 506*a* and the electrode 352 was not affected by soil of the core metal 506*a* or the like, so that stable contact became possible, and the sweep voltage functioned with stability.

Figure 13:
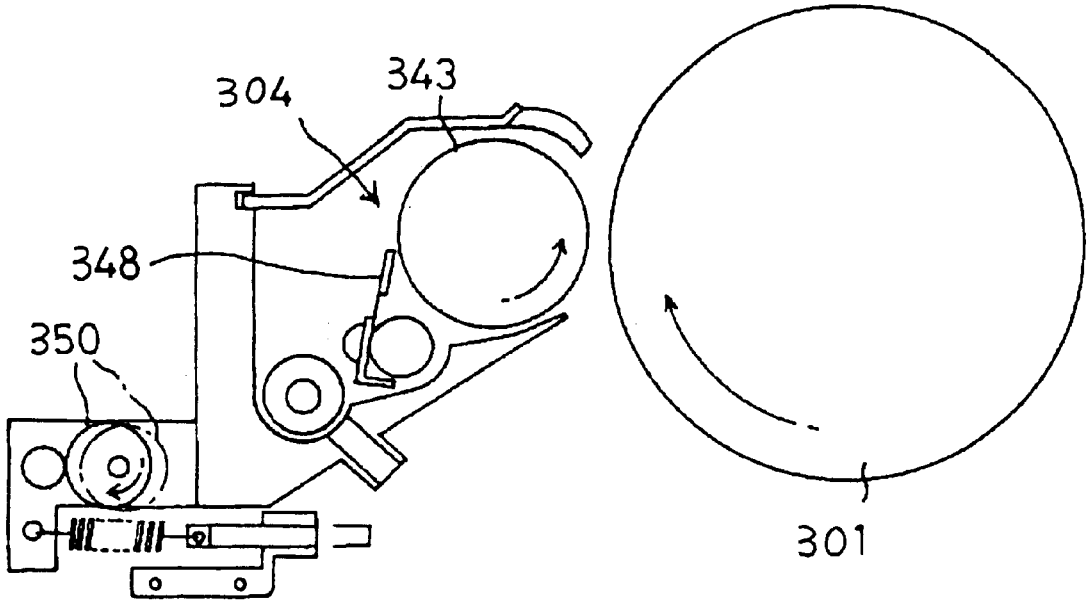
FIG. 13 is a cross-sectional front view showing the key section of the apparatus shown in FIG. 12 in another state.
Figure 14:
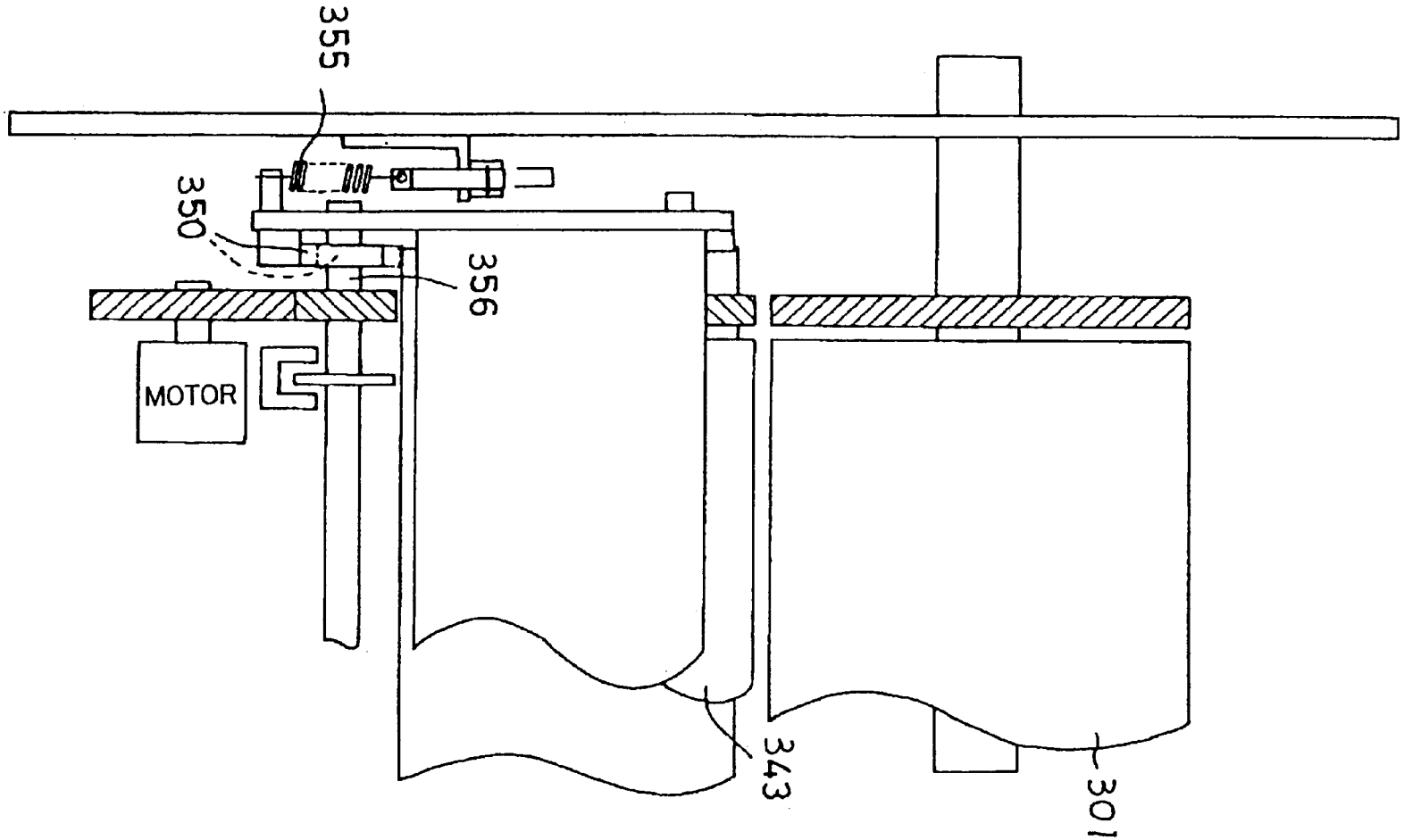
FIG. 14 is a plan view of the apparatus shown in FIGS. 12 and 13.
Figure 15:
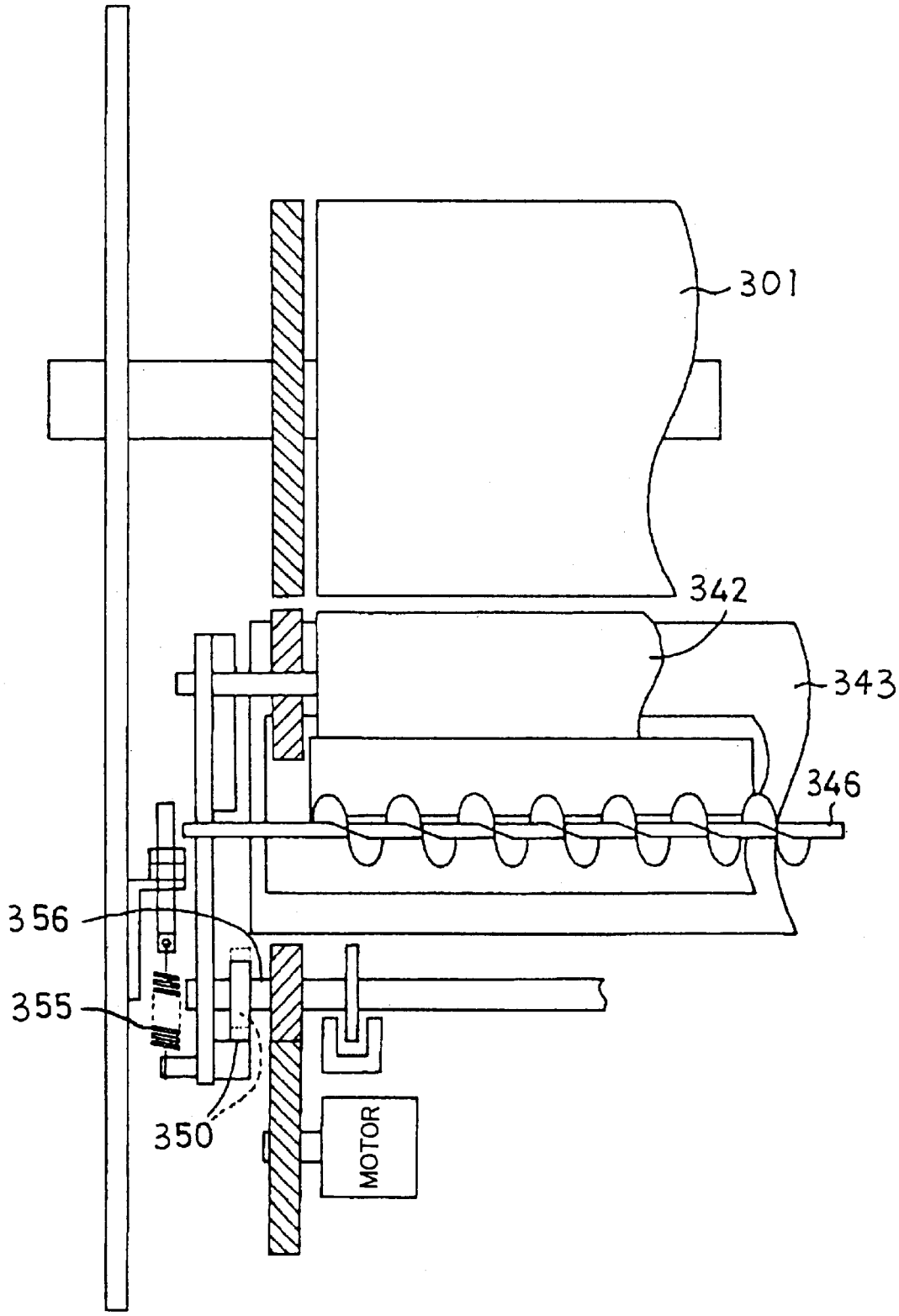
FIG. 15 is a bottom view of the apparatus shown in FIGS. 12 to 14.

The sweep roller unit is provided with a contact/separation mechanism in order to prevent permanent distortion of the sweep roller 343. The contact/separation mechanism brings the sweep roller 343 into contact with and separates it from the photoreceptor drum 301 when a contact/separation cam 350 rotates the sweep roller unit as shown in the figure. At a first position of the contact/separation cam 350 (the position indicated by the solid line in FIG. 12, the position indicated by the broken line in FIG. 13), the sweep roller 343 and the photoreceptor drum 301 come into contact with each other with a desired nip as explained later. At a second position of the contact/separation cam 350 (the position indicated by the broken line in FIG. 12, the position indicated by the solid line in FIG. 13), the contact/separation cam 350 pushes a contact/separation cam follower 351 in the direction in which the sweep roller 343 is separated from the photoreceptor drum 301, and thereby the sweep roller 343 and the photoreceptor drum 301 separate each other. The sweep roller unit adds a force to press the sweep roller 343 by a spring 355 in the direction in which the sweep roller 343 comes into contact with the photoreceptor drum 301. The contact/separation cam 350 uses a photosensor (not shown) capable of detecting positions corresponding to the first and second positions of the contact/separation cam 350, and operates by a sweep roller contact/separation motor through reception of a signal from a controller according to a print job. FIG. 12 and FIG. 13 show only one of the end parts of the contact/separation cam 350 disposed on the rotating shaft 356 coupled to the "motor" as shown in FIG. 14 and FIG. 15.

The image formation apparatus of this embodiment keeps its state at the contact/separation cam position B when the print job is not instructed, the apparatus is in an idling state, or the power is off, thereby distortion of the sweep roller 343 is prevented from being permanently set.

With regard to the nip between the photoreceptor drum 301 and the sweep roller 343, displacement can be controlled by pressing the sweep roller 343, but the nip is changed largely when an error occurs in a positional relation between the sweep roller 343 and the photoreceptor drum 301. Therefore, the sweep roller 343 and the photoreceptor drum 301 require high accuracy. However, in this embodiment, a pressure was controlled to form a nip, thereby it was possible to form a stable nip that was not affected depending on the machining accuracy of components. More specifically, a biasing unit with a spring is disposed in the sweep roller, and constant pressure is always applied to the unit toward the photoreceptor drum 301.

Further, an error during assembly of the components makes the nip nonuniform, but a desired nip is formed by rotating an adjusting screw and changing the length of a spring. Therefore, in this embodiment, the sweep roller 343 controlled a pressure toward the photoreceptor drum 301, thereby a uniform nip could be formed with respect to the longitudinal direction of the sweep roller.

In this embodiment, in order to drive the sweep roller 343 at the same speed as the speed in the circumferential direction of the photoreceptor drum 301, a gear 351 was disposed in the end of the photoreceptor drum 301, and a gear was also disposed at a position of the sweep roller 343 corresponding to the gear 351. In order to prevent unevenness in an image corresponding to a number of gear teeth perpendicular to the direction of outputting the image, a gear with inclined gear teeth was used. By using this, the image without uneven density could be obtained.

This embodiment has been explained using a system of imparting a driving force particularly from the photoreceptor drum 301 to the sweep roller 343 although this system is not suitable for minimization. However, a motor that singly drives the sweep roller 343 may be disposed.

In the embodiment of this invention, the driving force is imparted particularly from the photoreceptor drum 301 to the sweep roller 343 through the gears. Further, both of the gears 351 were designed so as to perform 1:1 rotation between the sweep roller 343 and the photoreceptor drum 301. However, the sweep roller 343 is pressed and deformed in order to form a nip. Therefore, a difference occurs between the surface velocity of the photoreceptor drum 301 and the surface velocity of the sweep roller 343 although the angular speed of the surface of the photoreceptor drum 301 and that of the sweep roller 343 are the same as each other and rotate in 1:1. That is, because the sweep roller 343 is distorted and rotated, the actual surface velocity of the sweep roller 343 is slightly higher with respect to the surface velocity of the photoreceptor drum 301. Therefore, in order to match the difference between the surface velocity of the photoreceptor drum 301 and that of the sweep roller 343 with the surface velocity of the photoreceptor drum 301, a one way clutch was disposed in the gear section of the sweep roller 343, so that the one way clutch would slip when the surface velocity of the sweep roller 343 was higher and thereby the difference would match the surface velocity of the photoreceptor drum 301. That is, the one way clutch that would slip in the rotating direction of the sweep roller was disposed. By introducing the one way clutch, the sweep roller excellently rotated with stability particularly when the developer did not adhere to the photoreceptor drum 301.

Figure 22A:
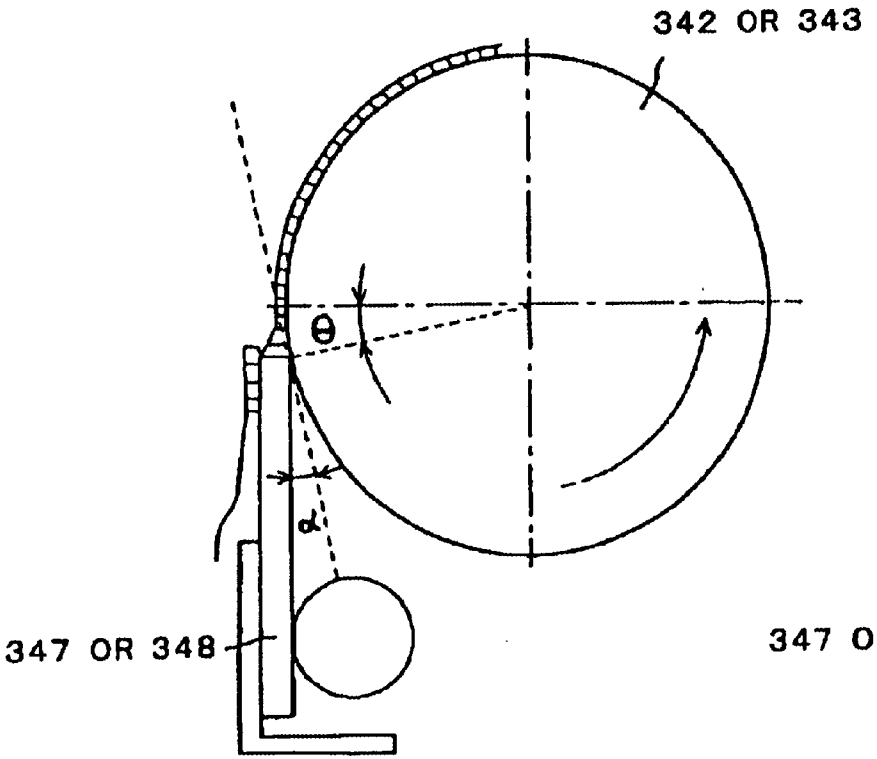
FIG. 22A and FIG. 22B each show the cleaning section of the apparatus shown in FIGS. 12 to 15.
Figure 22B:
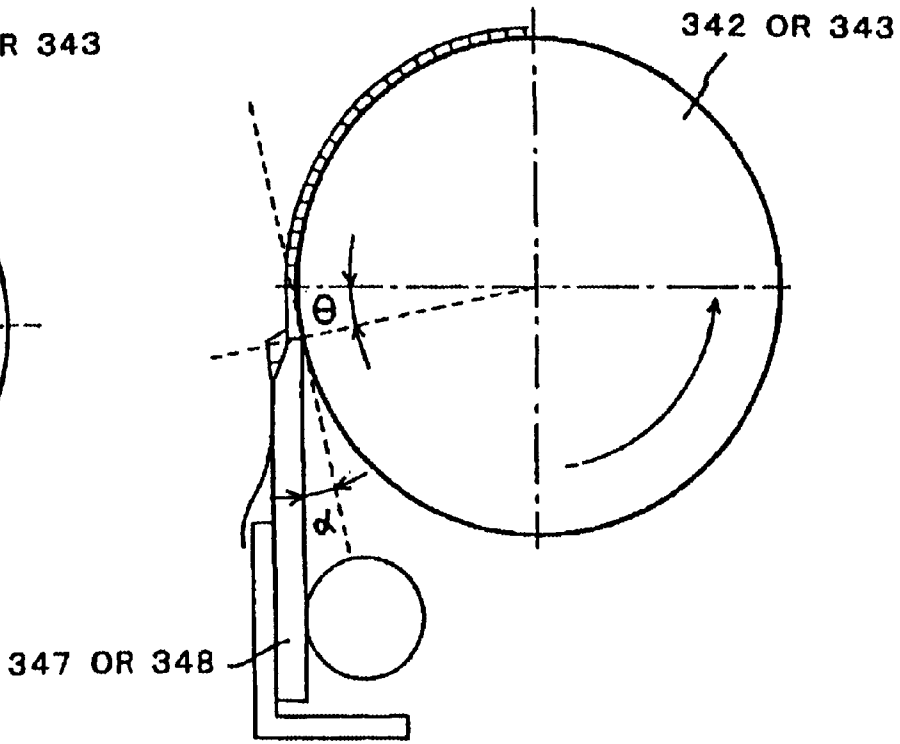

FIG. 22A and FIG. 22B are enlarged views of the cleaning section according to this invention. Each of these figures shows a relation between each of the developing roller 342 and the sweep roller 343 and each of the respective cleaning blades. The sweep roller 343 as a representative will be explained below.

Since the developer used in this embodiment was highly concentrated and highly viscous as explained above, when the developer on the sweep roller was to be recovered by the cleaning blade 348, it was difficult to facilitate development, recovery, and recycle because of low toner fluidity.

Therefore, the angle (x formed with the tangential line of the sweep roller and the blade exerts an effect on cleaning performance. The smaller the angle $\alpha$ becomes, the more effective the cleaning performance is. Particularly, the angle within a range about 10 to 30 degrees is adequate to obtain sufficient cleaning performance.

In order to recover the developer that is removed by the cleaning blade 348 and falls freely, a relation of a contact position (the shown angle $\theta$) between the two becomes further important. The condition of how the blade 348 comes into contact with the sweep roller largely exerts an effect on reduction in deposition of the developer on the front edge of the cleaning blade 348. In order to recover the developer using the gravity, the developer is present preferably in the lower left quadrant and lower right quadrant of the sweep roller. Therefore, when the angle $\theta$ at the contact position shown in the figure is greater, the contact condition of the blade 348 to the sweep roller is more effective. If the angle $\theta$ is 90 degrees or above, the thickness of the blade itself hardly exerts a bad effect on reduction in the deposited developer. Further, it is desirable that the blade 348 is disposed so that the angle $\theta$ becomes greater than the angle $\alpha$. It is, however, quite difficult to bring the blade 348 into contact with such a position.

Further, because the cleaning blade 348 has a thickness, the developer may be deposited thereon depending on the thickness of the contact part. Therefore, the thinner the thickness of the blade 348 is, the better the performance becomes if the whole rigidity as the blade 348 can be maintained. In this embodiment, when the blade 348 was formed of any highly rigid member such as metal or resin, the thickness was set to 1 mm or below, and preferably 0.15 mm.

As shown in FIG. 22B, the edge of the rear surface of the contact part is chamfered to reduce the accumulated amount of the liquid developer at the front edge of the blade 348 while maintaining sufficient rigidity of the whole blade 348.

Figure 23A:
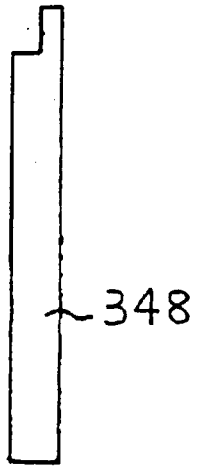
FIG. 23A and FIG. 23B each show a modified example of a cleaning blade according to this invention.
Figure 23B:
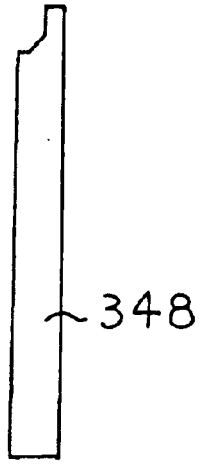

Although the example of chamfering the front edge to make thinner the thickness of the front edge of the blade 348 has been explained, the edge may have a step as shown in FIGS. 23A and 23B.

By the way, the metal blade is thin yet has sufficient rigidity, so that a contact pressure required for cleaning can be obtained. However, such a metal blade has a problem that it may damage the surface of the roller. Therefore, in claim 3 of this invention, the blade 348 formed of a resin member is used to perform cleaning. The resin member has the elastic constant ten times or above as compared to the elastic constant 2 to 10 MPa of an ordinary rubber material. Therefore, if the thickness is made to one-half of it, sufficient rigidity can be obtained. Assuming a free length is identical, the flexural rigidity of a plate material is proportional to the cube of its thickness, and is proportional to the elastic constant. Therefore, when the thickness becomes one half, the same degree of flexural rigidity can be obtained on condition that the elastic constant increases by eight times. For example, when a resin member having an elastic constant of 300 MPa is to be used, only a thickness of 1 mm is required to obtain sufficient rigidity. Further, the resin member has lower hardness as compared to that of metal, and less damages the surface of the sweep roller.

Figure 24:
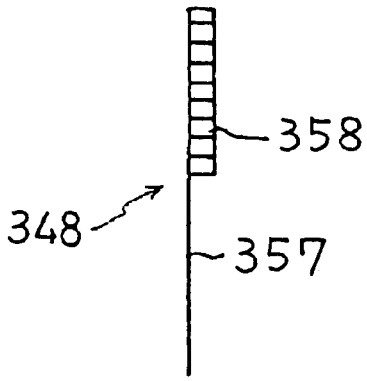
FIG. 24 shows another modified example of the cleaning blade of this invention.

In the resin blade, it is difficult to make smaller the angle Rat the cleaning edge, and its cleaning performance is inferior to that of the rubber blade. To solve this, a thin rubber blade 358 is bonded to a metal thin plate 357 to increase the cleaning performance. FIG. 24 shows an example of this blade, in which the rubber blade with a thickness of 11 mm is bonded to an SUS plate of 0.15 mm. The rubber can clean the surface of the sweep roller without any damage given to the surface, and in addition, the metal plate can produce a certain contact pressure required for cleaning. Further, the rubber plate itself does not need to produce rigidity to obtain the contact pressure, which enables the thickness of the whole plate to be as thin as about 1 mm.

The highly viscous liquid developer used in the device of this invention generally has thixotropic properties such that the viscosity increases as time elapses and shear needs to be acted on the liquid developer in order to lower the viscosity again. The viscosity increases due to such properties during flowing along the blade face, and the liquid developer cannot move only by gravity based on its own weight to adhere to the rear surface of the blade. If the liquid developer is not flowing due to its adhesion to the blade, a space and liquid developer required for that part are wasteful, which makes it difficult to minimize the device and reduce running costs. Therefore, in this invention, this part of the cleaning blade is subjected to oil-repellent treatment to reduce physical adhesive force of the liquid developer to the blade face, which makes it possible to prevent the adhesion. The device of this invention uses a fluorine-base coating agent as an oil-repellent agent. In general, such a fluorine-base coating agent needs to be heated up to 100 degrees or above to adhere to a non-coated surface. Although it is difficult to subject the resin member to treatment, the treatment is possibly performed on the surface of the metal member like the device of this invention.

Referring to the construction of the sweep roller and cleaning blade 348, the toner and carrier accumulated on the contact part of the blade are removed by the blade 348, and are then gradually accumulated on the blade 348 (because concentration of the solid portion is generally high and viscosity is high), but shear is given to the vicinity of the accumulated toner by a moving member to prevent its accumulation.

In this embodiment, the excess fogging toner and carrier on the photoreceptor drum 301 are removed by the sweep roller, and the removed toner and developer are recovered by the cleaning blade. Since the respectively recovered toner cannot move on its own, a conveying means such as a screw actively imparts the shear to the developer to be removed and conveys the removed developer to a developer regulating unit not shown. The removed developer has been changed in solid concentration and in a dispersed state, and the removed developer cannot therefore directly be recycled within the developing unit. Consequently, the developer is conveyed to the section where the developer regulating unit is disposed and is regulated for use again as a developer in a developing process.

A bias is applied to the cleaning blade so as to have the same potential as that of the sweep bias by making the cleaning blade and the holding member be electrically floated from the main body. By doing such, bias application can be stabilized, and any trouble due to discharge to another sections can be prevented.

When a member forming the cleaning blade is a resistor having resistivity of $10^{12}$ ohms-cm or above, the blade is possible to perform cleaning, but this case has a problem that the cleaning blade is charged by friction. Therefore, the bias potential applied to the sweep roller may be affected by this frictional charging. Even if the potential is not directly affected, there are some problems in terms of safety that the frictionally electrified charge may be discharged to another sections, which causes electrical noise to be produced, or may be discharged toward a worker. The cleaning blade is in contact with the sweep roller to prevent a bias from being leaked. Therefore, the cleaning blade including its holding member needs to be electrically floated from the main body and grounded.

An example of a case where a fourth embodiment of this invention is applied to the electrophotographic image formation apparatus as a wet-type image formation apparatus will be explained below. The basic construction of the fourth embodiment is the same as that of the third embodiment, and only different sections will be therefore explained here.

A developing device 304 according to the fourth embodiment of this invention will be explained below.

As shown in FIG. 12, the developing device 304 has main components such as the developer accommodation tank 341 that accommodates the developer 340 inside the tank, developing belt or developing roller (developing roller in this embodiment) 342 as a developer carrier, gravure roller 344 as an applying unit, gear pumps 345, and the agitating roller 346. In the fourth embodiment of this invention, a sweep roller 343 having elasticity is provided.

The sweep roller 343 has a layer of an elastic body (elastic layer 343*a*) having conductivity provided around its outer circumferential surface. The developing roller also has the layer of an elastic body having conductivity provided around its outer circumferential surface, but details of this layer are omitted in this embodiment. A preferred example of the layer will be explained in detail in a fifth embodiment as mentioned later.

The developing roller 342 and sweep roller 343 are provided with respective cleaning members 347 and 348 each formed of a metal blade or a rubber blade. The cleaning members 347 and 348 are not necessarily the blade but may employ a roller system. Further, the gravure roller 344 is provided with the doctor blade 349 as an apply-amount regulating unit for regulating the amount of liquid developer to be applied to the developing roller 342.

The sweep roller 343 is provided with a mechanism 350 of pressing the sweep roller 343 to the photoreceptor drum 301. As shown in FIG. 13, the pressing mechanism 350 uses adjusting members such as an eccentric cam and a spring to be capable of pressing the sweep roller 343 against and separating it from the photoreceptor drum 301.

Figure 25:
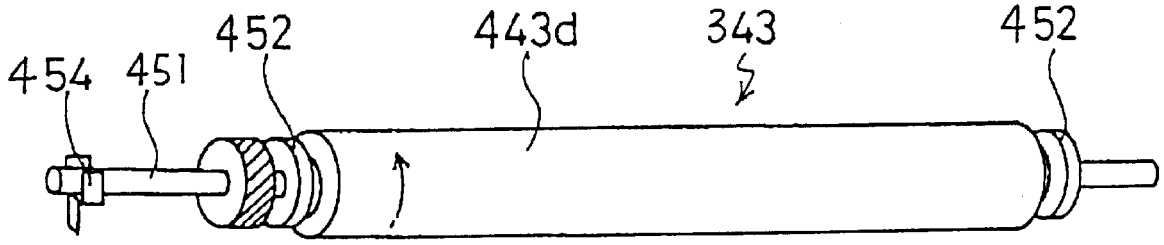
FIG. 25 is a perspective view of the sweep roller.
Figure 26:
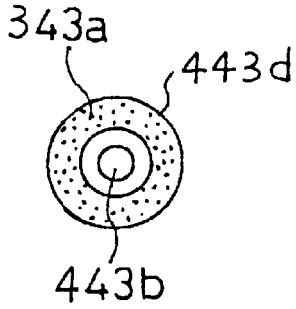
FIG. 26 is an example of the cross-sectional view of the sweep roller.
Figure 27:
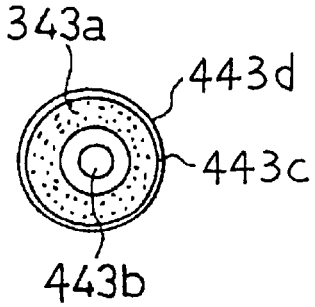
FIG. 27 is an example of the cross-sectional view of the sweep roller.

Such a sweep roller 343 has substantially the same length as the width of an image formed on the photoreceptor drum 301 as shown in FIG. 25. The sweep roller includes a sweep roller composed of the core metal 443*b* formed of a rigid body such as stainless steel and the elastic layer 343*a* formed around the core metal 443*b*, which is shown in FIG. 26, and a sweep roller with a surface layer 443*c* further formed on the surface of the sweep roller, which is shown in FIG. 27.

In FIG. 25, the paired cylindrical members 452 are disposed in both ends 451 of the sweep roller. More specifically, these members are cylindrical rollers whose outer dimension is smaller than that of the sweep roller 343 in order to adequately adjust a sweep nip width.

This elastic layer 343*a* preferably has appropriate elasticity, and desirably has a rubber hardness (JIS-A) of 50 degrees or below. An elastic member forming such an elastic layer 343*a* includes any foam formed of polystyrene, polyethylene, polyurethane, poly (vinyl chloride) or NBR (nitryl butylene rubber), or a low-hardness rubber member such as silicone rubber and urethane rubber. However, urethane base resin such as urethane rubber or silicone base resin such as silicone rubber is taken as a preferred example. When the surface layer 443*c* is provided, it is preferable to form the surface layer with a conductive member formed of a urethane rubber material which is hard to swell or deteriorate by the carrier liquid (silicone oil, etc.) of the liquid developer 340.

When a sweep voltage is applied from the core metal 443*b* of the sweep roller, an electrical resistivity of the sweep roller 343 is desirably adjusted to be $10^9$ ohms or below. For example, a synthetic rubber base binder in which conductive particles such as carbon black are dispersed is used as the elastic layer 343*a*, and the surface layer 443*c* is formed of a conductive film layer.

Figure 28:
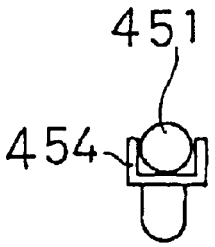
FIG. 28 is a side view of the sweep roller around an electrode.

As shown in FIG. 28, for example, the sweep voltage can be applied by pressing a leaf spring 454 such as a phosphorus bronze plate against the end face 451 of the core metal 443*b* so as to bring the spring into contact with the end face. Although the bias applying unit of the sweep roller 343 in particular has been explained using the leaf plate, the unit is not limited by this plate.

By dispersing conductive particles such as carbon black in the elastic body in order to impart conductivity to the elastic layer 343*a*, the hardness of the elastic layer 343*a* is in many cases increased, and thereby a desired resistivity may not be obtained in the elastic layer 343*a*. In this case, volume resistivity of the surface layer 443*c* may be adjusted to be $10^9$ ohms-cm or below. The sweep bias in this case may be applied by directly contacting the electrode with the roller surface 443*d*. In this embodiment, the sweep bias was applied by pressing the leaf plate such as a phosphorus bronze plate against the surface 443*d* of the roller so as to bring the plate into contact with the surface.

A cleaning blade 348 may be made conductive to be used also as a sweep bias applying unit. Although the bias applying unit of the sweep roller 343 has been explained using the leaf plate, the unit is not limited by this plate.

Any appropriate method can be used as the method of forming the surface layer 443*c* on the surface of the sweep roller 343 provided with the elastic layer 343*a*. For example, the method includes a method of coating the surface with a synthetic rubber base binder in which the conductive particles such as carbon black are dispersed, and a method of shielding the surface with a heat-shrinkable tube having conductivity and heating the tube to be shrunk. Alternatively, the elastic layer 343*a* may be formed inside the surface layer 443*c* by injecting an elastic material into the internal part of the tube having conductive or foaming the injected elastic material.

As the tube having conductivity, a resin tube formed of polyimide, polycarbonate, or nylon, or a metal tube formed of nickel, etc. is used. As the heat-shrinkable tube having conductivity, a resin tube formed of PFA or PTFE is used. Particularly, in order to prevent the liquid developer from adhering to the sweep roller, the PFA and PTFE tubes whose volume resistivity is about $10^6$ ohms-cm exhibit excellent effects. Further, by forming the surface layer 443*c* on the sweep roller 343, it is possible to suppress impregnation of the elastic layer 343*a* with the carrier liquid and increase in the hardness of the layer due to addition of the conductive additive such as conductive particles to the surface layer.

These tubes are desirably so called an endless tube that is seamless. Note that the sweep roller 343 may be formed of an elastic member such as urethane rubber that does not swell by silicone oil. In this case, there is no need to form the surface layer 443*c* on the surface of the sweep roller 343. However, in order to allow an electric developing bias to be applied to the sweep roller 343, it is necessary to set an electrical resistivity to a desired value by performing conductive process on the roller surface 443*d* or adding conductive particles to the elastic layer 343*a* that forms the sweep roller 343.

Figure 29:
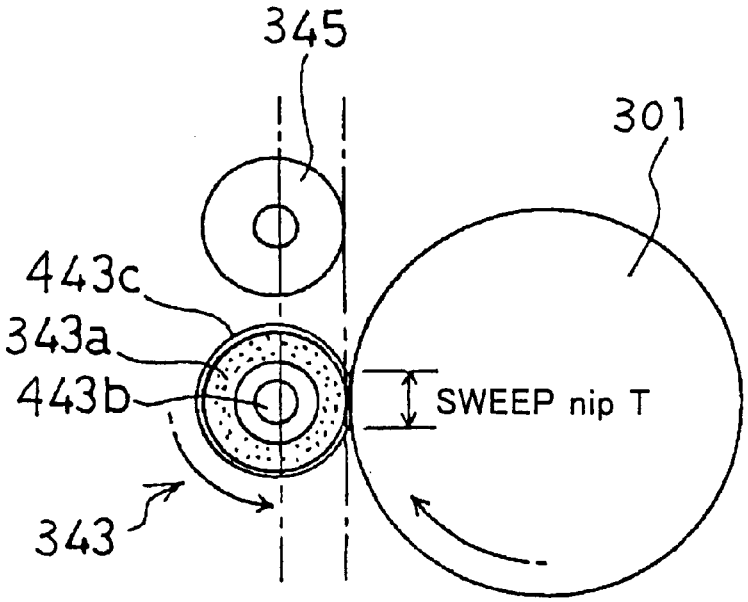
FIG. 29 shows the sweep nip as a contact part between the photoreceptor and the sweep roller.

The sweep roller 343 is disposed so as to come into contact with the photoreceptor drum 301, and rotates in the direction reverse to the rotating direction of the photoreceptor drum 301, that is, in the direction in which the sweep roller 343 follows the photoreceptor drum 301. The sweep roller 343 has a sweep nip T in FIG. 29, as a nip width T for removal, formed in the removal area through elastic deformation produced by a pressure of the sweep roller against the photoreceptor drum 301.

Figure 30:
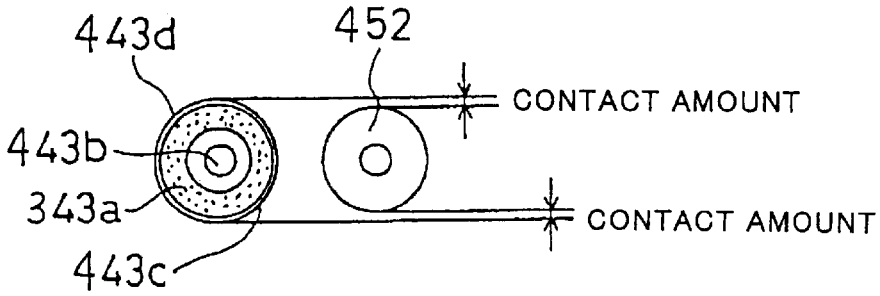
FIG. 30 is a view for explaining why the sweep nip is produced.

As shown in FIG. 30, the sweep nip width T can be stably obtained because the contact amount is regulated by the cylindrical member 452. Actually, the hardness of the sweep roller 343 is desirably 50 degrees (JIS-A) or below, and the sufficient result was obtained when it was 30 degrees (JIS-A) or below.

When the hardness is 50 degrees (JIS-A) or above, the surface is too hard, and it is therefore impossible to realize an optimal sweep nip and pressure required for bringing the sweep roller 343 into contact with the photoreceptor drum 301 while maintaining the liquid developer layer on the sweep roller and the image on the drum 301. The hardness of the sweep roller is determined based on a diameter of the photoreceptor drum and a diameter of the sweep roller to obtain a desired sweep nip width. The sweep roller needs to be disposed so as to form a fine gap between the sweep roller and the photoreceptor drum 301. This makes it difficult to dispose the sweep roller. The sweep nip width T produced in the sweep roller through its elastic deformation is set based on a relation between the capacitance formed with the developing roller, developer layer and the photoreceptor, and the development time constant defined by an electric circuit including a resistance component.

When the elastic layer 343*a* of the sweep roller 343 is a solid, the thickness of the surface layer 443*c* is preferably 100 $\mu$m or below. Accordingly, sufficient elasticity of the elastic layer 343*a* can be maintained. For example, when the outer diameter (diameter) of the sweep roller 343 is 24 mm, an excellent effect is obtained in a 70-$\mu$m surface layer 443*c*.

When the elastic layer 343*a* is a foam, an average pore diameter of the foam is desirably 300 $\mu$m or below, and the thickness of the surface layer 443*c* in this case is desirably set to a range from 10 to 70 $\mu$m because the pores become visible in an image when the thickness is 10 $\mu$m or below.

The sweep roller 343 is desirably constructed to have a surface smoothness of 3 $\mu$m or below as a value of surface roughness (Rz) by being coated or using a tube.

When the developing roller 342 is brought into contact with the photoreceptor drum 301 with adequate pressure, the elastic layer is elastically deformed to form a developing nip. By forming the developing nip, it is possible to ensure a predetermined developing time required for movement and adhesion of the toner in the liquid developer 340 to the photoreceptor drum 301 by the development electric field in the development area.

Further, by adjusting a contact pressure, a developing nip width as a size in the surface moving direction at the developing nip part can be adjusted. This developing nip width is set to a value not less than a product of the linear velocity of the roller and development time constant.

The development time constant mentioned here indicates a time required by the time when the development amount is saturated, and is a value obtained by dividing the developing nip width by a process speed. For example, when the developing nip width is 3 mm and the process speed is 300 mm/sec, the development time constant becomes 10 m·sec.

A thin layer of the liquid developer 340 is formed on the developing roller 342 by the gravure roller 344 during development. The thickness of the liquid developer 340 applied to the developing roller 342 at this time is desirably set to a value so that a pigment content in the toner carried on the surface per square cm will be within a range from 0.1 μg to 2 μg. To realize this, the thin layer of the liquid developer 340 may be applied with a thickness of 5 to 10 μm, and the applied amount can be obtained by controlling the doctor blade 349.

The reason is that when the applied thickness of the liquid developer 340 is such that the pigment content in the toner carried on the surface of the developing roller 342 per square cm will be smaller than 0.1 μg, a sufficient amount of pigment fails to migrate toward the image portion of the latent image formed on the photoreceptor drum 301, and the image density of the image portion may therefore become low. Further, when the thickness is such that the pigment content in the toner carried on the surface of the developing roller 342 per square cm is greater than 2 μg, a large amount of excess toner may remain on the background after development, and thereby imperfect removal of the toner may be performed by the sweep roller 343.

The thin layer of the liquid developer 340 formed on the surface of the developing roller 342 then passes through the developing nip formed with the photoreceptor drum 301 and the developing roller 342. In the electrophotographic developing device in general, the surface moving speed of the developing roller is set slightly higher than the surface moving speed of the photoreceptor, so that a sufficient amount of toner can be fed to an area where the photoreceptor and the developing device face each other. This, however, causes toner to move at a high speed relative to the surface of the photoreceptor and thereby brings about positional displacement between the toner and the latent image. Consequently, an image is sometimes blurred at the leading edge portion or sometimes has imbalance between vertical lines and horizontal lines. This phenomenon is also true for wet-type development. However, the image formation apparatus according to the fourth embodiment is free from the above-explained phenomena because the surface of the developing roller 342 and that of the photoreceptor drum 301 move at substantially the same speed and inhibit the toner from having a relative velocity vector in the tangential direction of the photoreceptor drum 301.

Figure 31A:
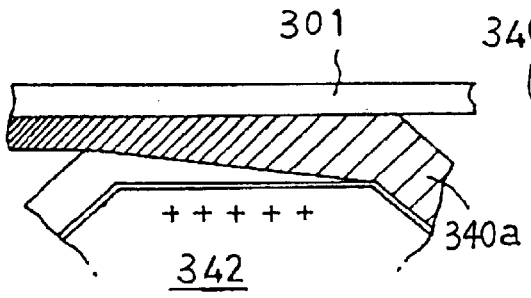
FIG. 31A and FIG. 31B each schematically show a state of the liquid developer at the developing nip.
Figure 31B:
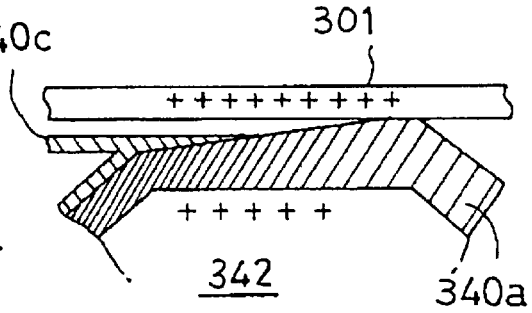

A developing bias voltage (400 V) lower than a surface potential of the photoreceptor (600 V) is applied to the developing roller 342. The bias forms a development electric field between the developing roller 342 and the image surface whose potential has been lowered to 50 V or below by the exposing device 303. FIG. 31A and FIG. 31B each schematically show a state of the liquid developer 340 at the developing nip. As shown in FIG. 31A, in the image portion of the photoreceptor drum 301, toner 340*a* contained in the liquid developer 340 migrates to the photoreceptor drum 301 by the electric field to visualize a latent image. On the other hand, in the background portion (non-image portion), as shown in FIG. 31B, the toner 340*a* is moved to the surface of the developing roller 342 due to the electric field formed by the developing bias potential and the potential at the photoreceptor so as to prevent the toner 340*a* from adhering to the background portion of the photoreceptor.

However, if part of the toner 340*a* on the background portion fails to migrate to the surface of the developing roller 342 and is left on the photoreceptor drum 301, which causes a fog. Therefore, the developing device 304 is provided with the sweep roller 343 in order to sweep the toner 340*c* which causes the fog (hereafter called "fogging toner"). This sweep roller 343 is disposed on the downstream side in the rotating direction of the photoreceptor drum 1 with respect to the developing roller 342 by being pressed against the photoreceptor drum 301 so that the developed toner layer is sandwiched by these two. The surface of the sweep roller 343 moves at substantially the same speed as the surface of the photoreceptor drum 301.

Figure 32A:
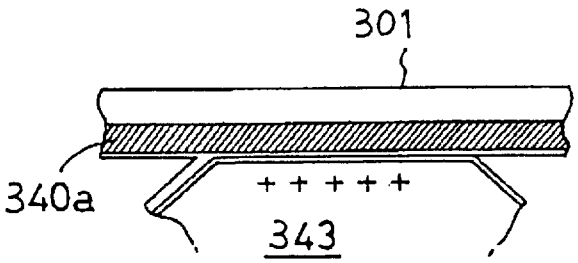
FIG. 32A and FIG. 32B each schematically show a state of the liquid developer at the sweep nip.
Figure 32B:
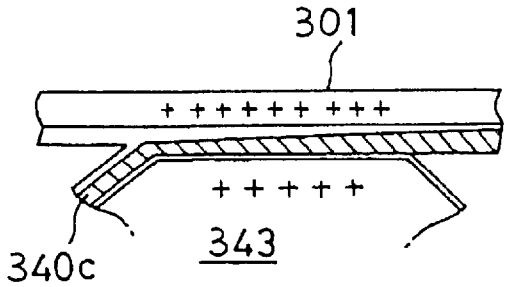

FIG. 32A and FIG. 32B each schematically show a state of the liquid developer at the sweep nip formed with the photoreceptor drum 301 and the sweep roller 343. A bias voltage (250 V) close to the surface potential (100 to 200 V) of the toner layer on the photoreceptor drum 301 is applied to the sweep roller 343 so as to prevent the toner 340*a* from returning from the toner layer to the sweep roller 343 after development. In the background, as shown in FIG. 32B, the stray fogging toner 340*c* is moved to the sweep roller 343 by the electric field produced by a difference between the potential at the background of the photoreceptor drum 301 and the potential based on the bias voltage. The developer layer of the background in this stage is about one-half of the thickness of the developing nip part on the developing roller 342 and the toner concentration lowers to about 20% of the concentration before development, thereby the fogging toner 340*c* can be easily removed. This can perfectly prevent the fog on the background. A relation of potentials satisfies the following relation, where a potential between the photoreceptor drum 301 and the developing roller 342 is VB1 and a potential between the photoreceptor drum 301 and the sweep roller 343 is VB2.

Photoreceptor potential >VB1>VB2> Toner layer potential By providing the sweep roller 343, the excess carrier liquid adhering to the background of the photoreceptor drum 301 can be removed by about one-half of it during development.

Further, the sweep roller 343 can efficiently remove the fogging toner 340*c*. Therefore, a slight amount of the fogging toner 340*c* may be allowed to remain at the developing nip between the photoreceptor drum 301 and the developing roller 342, and thereby the fog removal electric field (a potential difference between the developing bias applied to the developing roller 342 and a charge potential of the photoreceptor) can be suppressed to a minimum. Accordingly, the charge potential of the photoreceptor drum 301 can be lowered. Thus, various advantages as follows are obtained: enhancement in durability of the photoreceptor drum 301, reduction in load on the charger 302, and reduction in power for exposure, or the like.

Development and fogging toner removal of the background can also be simultaneously performed only by the developing roller. However, when fogging toner tries to be fully removed only by the developing roller, it is required to ensure a comparatively longer developing time (e.g., about 40 msec), and it is also required to make broader the developing nip width formed between the photoreceptor and the developing roller.

In order to make the developing nip width broader, the contact pressure between the photoreceptor and the developing roller tends to be increased. In contrast to this, the developing device 304 according to the fourth embodiment is provided with the sweep roller 343, and thereby the developing roller 342 is allowed to separate the function of development from the function of removal of the fogging toner 340*c*, which makes it possible to reduce the developing nip width as compared to the conventional one and to reduce the contact pressure (to e.g., 0.3 kgf/mm or below). Accordingly, it is possible to reduce the load on the photoreceptor drum 301, developing roller 342, and the sweep roller 343, and to enhance durability.

In the fourth embodiment, although the case where an image is formed by reversal development has been explained, the image can also be formed by normal development. When the image is formed based on the normal development, in the image formation apparatus constructed as explained above, a relation between potentials may be set as follows.

Photoreceptor Potential >Toner Layer Potential≧VB2>VB1> Non-image Portion Potential Wherein VB1 is a potential between the photoreceptor drum 301 and the developing roller 342, and VB2 is a potential between the photoreceptor drum 301 and the sweep roller 343. As an example of specific potentials, the photoreceptor potential is set to 600 V, toner layer potential to 200 to 300 V, VB2 to 200 V, VB1 to 100 V, and the non-image portion potential is set to 50 V.

Accordingly, the fourth embodiment can obtain the advantageous effect of this invention like the above mentioned embodiments.

An image formation apparatus according to a fifth embodiment of this invention will be explained below. However, the same numbers are assigned to those the same as or equivalent to the sections and members of the fourth embodiment, and detailed explanation is omitted.

Figure 33:
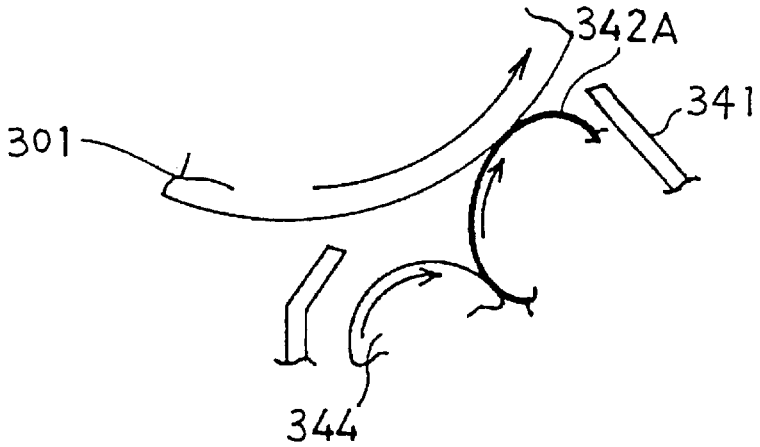
FIG. 33 is a partial schematic view when viewed from the cross section of the image formation apparatus of this invention.

The photoreceptor 301 of the fifth embodiment of this invention has a variation such as a belt like photoreceptor in addition to the drum like photoreceptor explained in the fourth embodiment. As shown in FIG. 33, a belt like developer carrier (developing belt 342A) such as an endless belt is often used instead of the developing roller as a developer carrier. The developing belt 342A of FIG. 33 is so constructed as to rotate with the rotation of the photoreceptor drum 301 by being nipped between belt supports not shown or being horizontally supported by the belt supports.

The developing device 304 as characteristics of the fifth embodiment in which a developer carrier is a roller will be explained below.

The developer carrier in the fifth embodiment of this invention requires urethane base resin having conductivity. It is preferable for formation of a developing nip that the material of the developer carrier has flexibility, but any material having flexibility cannot always be employed as a material used to form the developer carrier. It has been found based on studies carried out by the inventors of this invention that the urethane base resin is the most appropriate in terms of image stability and durability.

Generally, a flexible material such as rubber is made by impregnating a row material with oil. This is referred to as impregnating oil. In any liquid developing device using a developing roller having flexibility formed of any material but the urethane base resin, increase of using time of the developing roller causes deterioration in the roller itself to begin, and inconvenience due to seepage of the impregnating oil has been recognized.

For example, when the impregnating oil seeps through the resin, the resin, that forms a developer carrier such as the developing roller, becomes rid of oil, and thereby the resin is hardened. Therefore, it is impossible for the resin to maintain predetermined flexibility. Accordingly, there occur such inconveniences as image degradation and damages to the surface of the photoreceptor as a latent image carrier. Further, the seepage of the impregnating oil into the liquid developer may cause the properties of the liquid developer to largely change.

In general, the liquid developer is accurately set so that optimal properties can be maintained in terms of electric properties and thermal properties. However, the impregnating oil is mixed into the liquid developer to make these properties changed, which may result in damage to the image stability.

In contrast to this, when the urethane base resin is used as a developer carrier, the molecular structure itself has flexibility, and the developer carrier is therefore allowed to have predetermined flexibility even if an oil content is suppressed to a minimum. Accordingly, it has been found that the urethane base resin is the most appropriate for an image outputting device using a liquid developer in which carrier is liquid. Further, the urethane base resin does not swell by contacting oil, for example, silicone oil as carrier liquid except impregnating oil, so that it is possible to ensure sufficient flexibility in the liquid developing system in which a latent image carrier such as a photoreceptor and a developer carrier come into contact with each other. Further, this urethane base resin can contain carbon in the resin and conductivity can be therefore set to a desired value.

The urethane base resin having such chemical properties exhibits the same effect even if the developer carrier is a roller-like or belt-like carrier, or even if the shape is changed, therefore, the urethane base resin is the most appropriate for the developing roller and developing belt.

Figure 34:
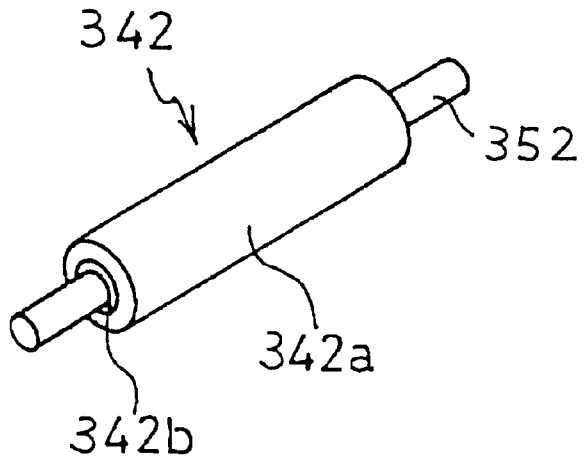
FIG. 34 is a perspective view of the developing roller shown in FIG. 12.

As shown in FIG. 34, the developing roller 342 has a layer of an elastic body (elastic layer 342*a*) having conductivity provided around its outer circumferential surface. The material of this elastic layer 342*a* requires flexibility for forming a developing nip.

The developing roller 342 is used as a developer carrier to enable minimization of the developing device itself. When the belt like developer carrier is provided as explained later, an appropriate mechanism that prevents displacement occurring specifically to the developing belt is required, which may cause the number of components to be increased. In contrast, with the developing roller, it is possible to reduce the number of necessary components. Although the device can be made compact in size, the developing roller in turn needs to have higher flexibility to ensure a sufficient developing nip width at the time of coming into contact with the photoreceptor drum 301.

By experiment, an excellent image could be obtained when the developing roller had a rubber hardness of 40 degrees (JIS-A) or below. The roller having a rubber hardness of 40 degrees or above was too hard to form a desired developing nip width, and thereby a developing time required for transfer of toner could not be ensured. As a result, image density was lowered. When the photoreceptor drum 301 and the developing roller 342 are in contact with each other and a developing process is performed, because the developing roller 342 is hard, a force higher than the set value is applied to the rotating shaft, which may cause the machine to be damaged. Therefore, the hardness is desirably 40 degrees (JIS-A) or below.

Figure 35:
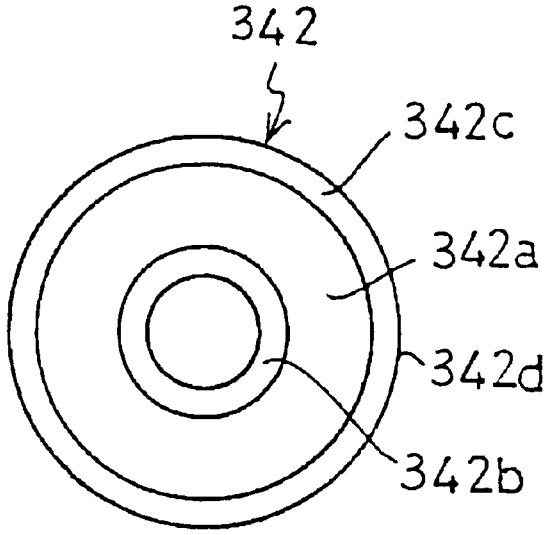
FIG. 35 shows an example of the cross-sectional view of the developing roller.

As shown in FIG. 34 and FIG. 35, the developing roller 342 is composed of the shaft 342*b* as a metal part and flexible parts 342*a* and 342*c* other than the shaft because the developing roller 342 generally needs rigidity. In this embodiment, metal was used for the shaft 342*b*, on which the elastic layer 342*a* and the surface layer 342*c* were formed of the urethane base resin. The elastic layer 342*a* and the surface layer 342*c* may be formed of different materials, respectively. A sufficient effect can be obtained if the material has a predetermined value of flexibility. The developing process is performed generally by applying a developing bias to the developing roller to transfer toner onto the photoreceptor. However, the developing roller has desirably lower resistance in terms of electrical efficiency.

According to the experiment, it has been found that an evenly developed image can be output when electrical resistivity from the shaft 342*b* through the roller surface 342*d* (called "effective resistance of the developing roller") is $10^9$ ohms or below. The roller whose effective resistance is $10^9$ ohms or above has high electrical resistivity, and development may not therefore be reliably performed. As a result, unevenness in image density caused by uneven resistance was recognized.

The effective resistance of the roller is preferably as low as possible in terms of electrical efficiency, but it is also recognized that inconvenience caused by a fully conductive material may occur. The surface of the photoreceptor drum 301 as a latent image carrier is not always kept in the same state by coming into contact with the developer carrier, and the sweep roller 343, transfer device 305, electrifying charger or charging roller as the charger 302 explained in the fourth embodiment. The electrifying charger conducts non-contact charging, but may cause an abnormal discharge toward the photoreceptor drum 301 to occur.

As a photoreceptive layer generating a latent image, any layer with a thickness of a range from about 30 $\mu$m to 80 $\mu$m is generally used. If there is a bad contact state between each component for image formation such as the developing roller 342 and the photoreceptive layer, the photoreceptive layer may be damaged. It has been found that an abnormal discharge may occur under this state, unless the developing roller 342 is allowed to have some effective resistance, and that an image cannot be output and durability of the device is largely decreased. In the experiment, occurrence of abnormal discharge was not recognized in the developing roller having an effective resistance of $10^3$ ohms, whereas output of an image was recognized. When the same photoreceptor drum 301 was used and an image was output by the developing roller whose effective resistance was $10^2$ ohms, abnormal discharge was recognized. Therefore, the drum was replaced with a new photoreceptor drum 301 and an image was output in the same manner as explained above. This time, there was no abnormal discharge, and an image seemed not to be affected by the discharge. It is conceivable that the new photoreceptor drum 301 did not have some damages such as scratches on its photoreceptive layer and thereby abnormal discharge did not also occur in the developing roller 342 with low effective resistance. On the other hand, it can be thought that the photoreceptor drum 301 before being replaced had some scratches on its photoreceptive layer because of high frequency of using it, the conductive layer as a base of the drum was exposed, to which a potential was applied, and abnormal discharge occurred.

It has been found that the damages of the photoreceptor drum 301 occurred not only when the photoreceptive layer was physically peeled but even when electrical characteristics and electrical capacitance of the photoreceptive layer were locally damaged. The damage of this photoreceptive layer cannot be visually recognized as a physical damage. The optimal effective resistance of the developing roller changes depending on the state of the photoreceptor drum 301, but by regulating the effective resistance of the developing roller to $10^9$ ohms or below, unevenness in the image cannot be recognized, which has made it clear that image quality could be improved thereby.

When the developing roller 342 and sweep roller 343 are brought into contact with the photoreceptor drum 301 with respective adequate pressure, the elastic layers 342*a* and 343*a* of the rollers are elastically deformed to form a developing nip and a sweep nip, respectively. Particularly, by forming the developing nip, it is possible to ensure a predetermined developing time required for movement and adhesion of the toner in the developer 340 to the photoreceptor drum 301 by the development electric field in the development area. Further, by adjusting a contact pressure, a nip width as a size in the surface moving direction at each nip part can be adjusted.

If layout of components is restricted when the developing device is designed, by forming the developer carrier to a belt-like carrier, flexibility can be given to the layout. In this case, a problem such as belt deviation, which never occurs in the developing roller, may occur, and it is therefore required to prevent belt deviation using any appropriate method. Prevention of the belt deviation in the liquid developing device is disclosed in Japanese Patent Application Laid-Open No. 2000-47490. This embodiment has solved inconvenience such that the developing belt runs onto the side by disposing suspension rollers to prevent the deviation or by forming conical buildups at the roller ends. For example, conical deviation stops may be disposed on the ends of the suspension roller.

By forming the developer carrier to a belt-like carrier, a developing nip width can be easily made broader than that of the developing roller, and thereby sufficient developing process can be performed. Further, it has been found that lower flexibility of the belt itself than that of the developing roller does not affect the image because the developing nip width can be made broader. Accordingly, an image output in the same method as that of the developing roller was evaluated, and as a result, the excellent image could be output by the developing belt whose surface has a rubber hardness of 60 degrees (JIS-A) or below. It has been also clear that uneven development was recognized on the image and image quality was degraded with the developing belt having the rubber hardness of 60 degrees (JIS-A) or above.

When any other material except a material having a rubber hardness within a range from 40 degrees to 60 degrees (JIS-A) cannot be employed as a developer carrier because of a manufacturing restriction including the material of rubber or selection of a conductive additive agent such as conductive particles, it is possible to improve image quality by forming the developer carrier to a belt-like carrier.

The surface roughness of the developer carrier, which comes into contact with the photoreceptor drum 301 and performs a developing process, exerts an effect on an image. If the surface is rough, the roughness exerts an effect on transfer of image visualizing particles to the photoreceptor, which makes it impossible to obtain uniform image density. As a result of careful studies, it has been found that density unevenness on the image can be lowered by reducing the surface roughness value of the developer carrier surface to 3 $\mu$m or below (Rz). This result is obtained in a case where the surface is made of urethane base resin, but if the surface roughness value cannot be reduced to 3 $\mu$m or below because of manufacturing restriction to the roller, the surface layer of the urethane base resin is coated, and by reducing the surface roughness value of the coated layer (surface layer) to 3 $\mu$m or below, the same advantageous effect can be obtained. It has also been found that the same advantageous effect can be obtained by using the urethane base resin formed of urethane base resin itself as a base of the developing belt and providing a coated layer on its surface layer.

When the urethane base resin is used as a developing roller or a developing belt, a developing nip width needs to be made broader as required depending on properties of each liquid developer. When the developing belt is used, it is comparatively easier to make the developing nip width broader as compared to the developing roller, but this is difficult for the developing roller. Although it is possible to produce a developer carrier having desired electrical resistivity by compensating for conductivity by containing carbon in the urethane base resin, the carbon-containing urethane base resin generally tends to become hard.

It has been found that when the developing nip width needs to be made longer depending on properties of each liquid developer, by providing the surface layer 342*c* to ensure conductivity of this surface layer 342*c*, image quality can eventually be improved by effectively deriving developing bias while allowing the developing roller to have flexibility that the urethane base resin has. Although this experiment was carried out only using the developing roller 342, it is thought to obtain the same effect by providing the surface layer even when the developing belt 342A is used. However, the developing belt is generally required to be made thinner as compared to the developing roller because of its construction, therefore, it is predicted that the effect will not be as good as that of the developing roller.

In the fifth embodiment, the photoreceptor drum 301 is not particularly restricted, but it is recognized that amorphous silicon (D 6L) is the best for the drum in relation with the developer carrier. By forming the photoreceptor drum 301 with D 6L, it is possible to reduce damages to the surface of the photoreceptor drum 301 due to being in contact with the developing roller 342 or the developing belt 342A, and to reduce degradation in the photoreceptor surface due to water absorption or swelling caused by changing of its surroundings.

As explained above, according to this invention, the excess toner remaining area on the latent image carrier is prevented to occur. Therefore, there is an advantageous effect that a transfer medium and peripheral members can be prevented from being soiled due to residual excess toner.

According to this invention, excess toner is prevented from being left in an area where the removing member and the latent image carrier face each other. Therefore, there is an advantageous effect that the function of the removing member that removes excess toner from the surface of the latent image carrier can be prevented from being lowered.

According to this invention, there is an advantageous effect that excess toner can be prevented from re-adhering from the removing member to any other parts excluding the image portion on the latent image carrier surface.

In the structure in which an image formed on the latent image carrier surface is transferred to a transfer medium, there is an advantageous effect that the non-image portion of the transfer medium can be prevented from being soiled with excess toner, and that the load on the cleaning unit can be prevented from being increased when the cleaning unit for cleaning the transfer medium is provided.

In the structure in which the latent image carrier cleaning unit for cleaning the latent image carrier surface after an image is transferred is provided, there is an advantageous effect that the load on the latent image carrier cleaning unit can be prevented from being increased.

According to this invention, the excess toner remaining on the latent image carrier surface without being removed therefrom does not transfer to the transfer medium. Therefore, there is an advantageous effect that the transfer medium can be prevented from being soiled.

Even if the excess toner adhering to the end part of the removing member re-adheres in a streak to the surface of the latent image carrier, the transfer medium does not contact this re-adhering area. Therefore, there is an advantageous effect that the streaked toner re-adhering to the surface can be prevented from soiling the transfer medium.

In the structure in which the cleaning unit for cleaning the transfer medium is provided, there is an advantageous effect that the load of the cleaning unit can be reduced.

According to the liquid image formation apparatus of this invention, the excess toner stuck in both ends of the removing member in its width direction and re-adhering to the latent image carrier can be cleaned. Therefore, there is an advantageous effect that excess toner can be prevented from its dropping or scattering to the internal side of the apparatus due to re-adhesion of the excess toner to the latent image carrier.

There is an advantageous effect that it is also possible to clean particularly the excess toner in a streak re-adhering to the latent image carrier surface occurring as a result of setting the width in the main scanning direction of the cleaning member for the removing member as mentioned above.

According to this invention, the excess toner on the latent image carrier can be efficiently recycled for development. Therefore, there is an excellent effect that the toner can be made effective use of.

Particularly, in the mode capable of preventing re-adhesion of excess toner from the removing member to the non-image portion of the latent image carrier surface, there is an advantageous effect that the toner can be made effective use of.

According to this invention, the after-transfer residual toner on the latent image carrier can be efficiently recycled for development. Therefore, there is an excellent effect that the toner can be made effective use of.

Particularly, in the mode capable of cleaning the excess toner adhering to the outside of both ends in the width direction of the removing member in the contact area with respect to the latent image carrier, there is an advantageous effect that the toner can be made more effective use of.

According to this invention, reliability and durability of the developing roller can be enhanced by eliminating permanent distortion of the developing roller due to being in a pressure and contact state.

According to this invention, the latent image carrier and the developing roller are rotated together with each other when the developing roller and the latent image carrier come into contact with or separate from each other. Therefore, the developing roller and the latent image carrier can be prevented from being worn and damaged due to their rubbing against each other.

According to this invention, it is possible to prevent damages on the surface of the developing roller or the surface of the latent image carrier based on abnormal discharge occurring immediately before the developing roller comes into contact with the latent image carrier or immediately after the developing roller is separated from the latent image carrier.

According to this invention, it is possible to prevent wasteful consumption of toner when the developing roller and the latent image carrier come into contact with and separate from each other.

According to this invention, a time until the contact part of the photoreceptor with the developing roller reaches the sweep roller is set to 0.5 sec or below, thus obtaining excellent developing characteristics with less image degradation.

According to this invention, a time until the contact part of the photoreceptor with the sweep roller reaches the transfer position is set to 0.7 sec or below, thus obtaining excellent developing characteristics with less image degradation.

According to this invention, a photoreceptor formed of amorphous silicon having a high dielectric constant is used, thus improving a practical development electric field.

In the conventional method of simultaneously performing development of an image and removal of fogging toner on the background by the developer carrier in order to ensure a comparatively longer developing time, the size of the nip part (hereafter called "developing nip width") formed between the latent image carrier and the developer carrier in the direction in which the surface of the developer carrier moves was made broader. Particularly, when at least either one of the latent image carrier and the developer carrier has elasticity and a nip part is formed by bringing the developer carrier into contact with the latent image carrier, a contact pressure tends to be increased in order to make broader the developing nip width.

According to this invention, the liquid developing device is provided with the sweep roller, and the developer carrier does not therefore need to fully remove the excess toner, thus reducing a developing time and making the developing nip width smaller. Accordingly, it is possible to reduce the contact pressure of the developer carrier against the latent image carrier. Further, the sweep roller is brought into contact with the latent image carrier to form the nip part, and thereby it is possible to ensure more time required for removing the excess toner by the sweep roller and more surely remove the excess toner.

According to this invention, the sweep roller can surely remove the excess toner remaining on the latent image carrier after development. Therefore, there is an advantageous effect that high quality images can be formed by preventing image fog.

By providing the sweep roller, the developer carrier does not need to fully remove the excess toner, thus reducing a charge potential of the latent image carrier. Accordingly, there is an excellent effect that durability of the rollers can be enhanced. Further, part of the excess carrier on the latent image carrier after development can be removed by the sweep roller. There is another advantageous effect that the amount of carrier consumption can be reduced.

According to this invention, the latent image formed on the latent image carrier is developed by the liquid developer carried on the developer carrier. Even if the toner adheres to the background portion (non-image portion) on the latent image carrier after the development and the excess toner remains thereon, the excess toner and the carrier liquid can be removed by the sweep roller. Thus, it is possible to prevent image fog due to the excess toner and reduce consumption of the carrier liquid.

According to this invention, the nip forming unit forms a nip using the unit of controlling a pressure for the sweep roller to the latent image carrier to enable prevention of changes in the nip width due to variations in precision of components for the sweep roller.

The pressure control unit of the liquid developing device can control a pressure and adjust a nip.

In the liquid developing device, the unit of applying a sweep voltage to the sweep roller is formed of a conductive biasing member, and the biasing member can apply a sweep voltage to the sweep roller by coming into contact with this roller.

The sweep voltage applying unit of the liquid developing device provides the conductive wearing member on the contact surface with the sweep roller so that the contact part between the sweep roller and the sweep voltage applying unit always wears, and thereby poor contact due to dirt or the like of the contact surface can be prevented.

The sweep voltage applying unit of the liquid developing device applies a sweep voltage to the sweep roller by coming into contact with the core metal of the sweep roller, and thereby a stable sweep voltage can be applied.

In the liquid developing device, the rotation driving unit has the latent image carrier end gear disposed in the end part of the latent image carrier, and has the sweep roller end gear disposed in the end part of the sweep roller so as to be engaged with the latent image carrier end gear, and can rotate the sweep roller.

The surface moving speed of the developer carrier is set to substantially the same as the surface moving speed of the latent image carrier, thus obtaining images with less image unevenness.

The rotation driving unit of the liquid developing device has the one way clutch disposed on the sweep roller end gear. Accordingly, a difference between the surface moving speed of the developer carrier and the surface moving speed of the latent image carrier is corrected to enable prevention of image unevenness.

In the liquid developing device, the contact/separation unit is so constructed that the sweep roller can be separated from the latent image carrier by the displacing device and the sweep roller can be brought into contact with the latent image carrier by the pressure control unit.

The contact/separation unit of the liquid developing device is so constructed that the displacing device is a cam and the sweep roller can separate from the latent image carrier through rotation of the cam.

In the liquid developing device, the sweep roller formed of the elastic body is formed in a multilayer structure including a core metal and at least one layer, thus realizing desired elasticity and electrical resistivity.

In the liquid developing device, the volume resistivity of the sweep roller formed of the elastic body is regulated to $10^9$ ohms-cm or below, thus successfully applying a sweep voltage without leakage of the sweep voltage and preventing abnormal images.

In the liquid developing device, the hardness of the sweep roller formed of the elastic body is set to 50 degrees (JIS-A) or below, thus preventing occurrence of image flow.

In the liquid developing device, the sweep roller formed of the elastic body does not swell by the carrier liquid of the developer, nor is impregnated therewith, thus preventing deterioration of the sweep roller.

In the liquid developing device, the surface layer of the sweep roller formed of the elastic body is a film layer of 100 $\mu$m or below. Thus, it is possible to obtain a desired elasticity, prevent deterioration of the sweep roller, and prevent adhesion of the toner to the surface layer.

In the liquid developing device, the sweep roller surface layer formed of the elastic body is a film layer having a volume resistivity of $10^9$ ohms-cm or below. Thus, it is possible to obtain a desired electrical resistivity, prevent deterioration of the sweep roller, and prevent adhesion of the toner to the surface layer.

The liquid developing device comprises the development voltage applying unit which applies a voltage to the developer carrier. More specifically, this voltage produces an electric field between an image portion of the latent image and the developer carrier, and this electric field has a direction that moves the toner to the image portion. The liquid developing device also comprises the sweep voltage applying unit which applies a voltage to the sweep roller. More specifically, this voltage produces an electric field having a direction that attracts stray excess toner present between the background of the latent image and the sweep roller to the sweep roller, and the electric field is not so strong as the toner adhering to the image portion is peeled. Based on this construction, the excess toner can be recovered.

In the liquid developing device according to this invention, the development voltage applying unit moves the toner to the image portion side to develop the image portion. The sweep voltage applying unit does not peel the toner adhering to the image portion but moves the stray excess toner present on the background to the sweep roller, and can remove the excess toner.

In the electrophotographic developing device in general, the surface moving speed of the developing roller is set slightly higher than that of the latent image carrier, so that a sufficient amount of toner can be fed to an area where the latent image carrier and the developing device face each other. This, however, causes toner to move at a high speed relative to the surface of the latent image carrier and thereby brings about positional displacement between the toner and the latent image. Consequently, an image is sometimes blurred at the leading edge portion or sometimes has imbalance between vertical lines and horizontal lines. This phenomenon is also true for development using a liquid developer. The liquid developing device is free from the above-explained phenomena because the surface of the developer carrier and that of the latent image carrier move at substantially the same speed and inhibit the toner from having a relative velocity vector in the tangential direction of the latent image carrier.

The sweep roller removes excess developer on the latent image carrier after development. Thus, the excess developer can be removed more reliably, which makes it possible to form high quality image by preventing image fog.

According to this invention, the sweep roller is separated from the latent image carrier when the liquid developing device or the liquid image formation apparatus is not in use, which makes it possible to prevent permanent distortion of the sweep roller.

According to this invention, the removing member can surely remove excess toner remaining on the latent image carrier after development and recover carrier. Therefore, there are excellent effects that high quality images can be formed by preventing image fog and excess carrier can be recovered. Further, by providing the removing member, the developer carrier does not need to fully remove the excess toner, which makes it possible to lower a charge potential of the latent image carrier. Thus, there is also an advantageous effect that durability of the rollers can be enhance.

The removing member can remove part of excess carrier on the latent image carrier after development, thus, there is also an excellent effect that the amount of carrier consumption can be reduced. The wet-type developing device according to this invention is provided with the cleaning unit for cleaning the surface of the sweep roller to recover excess toner and carrier liquid. During recovery, if the contact position of the blade is high, toner adheres to the front edge of the blade and therefore does not flow down. However, the blade is disposed at least at the central position or lower, which makes the toner flow down.

According to this invention, the cleaning blade is disposed so that the angle $\theta$ at a contact position of the cleaning blade with the sweep roller is greater than the angle $\alpha$ formed with the tangential direction at the contact point of the blade and the blade, thus reducing toner accumulation at the front edge of the blade.

According to this invention, any rubber member (e.g., urethane) as follows is used. This rubber member is excellent in cleaning performance, does not damage the surface of the sweep roller that removes excess toner, and has a JISA hardness within a range from 50 degrees to 80 degrees. The thickness of the front edge is made thinner as compared to the other part, and thereby the sweep roller is excellent in cleaning performance and toner is prevented to stay at the front edge of the blade. Thus, the toner can flow down smoothly.

According to this invention, any blade formed of a resin material having high rigidity than the rubber member is used to obtain sufficient rigidity even through it is thin, thus ensuring excellent cleaning performance.

According to this invention, sufficient cleaning performance can be ensured by using the cleaning blade with a rubber member, not damaging the surface of a developer support, bonded to a metal plate through which sufficient rigidity can be obtained even through it is thin.

According to this invention, the rear side of the cleaning blade is subjected to oil-repellent treatment to reduce physical adhesive force of the liquid developer to the blade face, which makes it possible to prevent adhesion of the liquid developer.

According to this invention, the conveying unit, which moves toner after being removed in an axial direction, disposed close to the cleaning blade, thus facilitating recycling.

According to this invention, an angle of the cleaning blade is formed in a minus direction with respect to a vertical direction, and a moving member is disposed in the vicinity of the cleaning blade, thereby toner accumulating on the blade can surely be recovered.

According to this invention, influence of triboelectricity between the sweep roller for removing excess toner and the cleaning member is eliminated and thereby stable developing bias can be applied to the developing roller. Further, discharge due to the electrified charge is eliminated and thereby electrical noise can be prevented from occurrence.

According to this invention, in the liquid developing device, influence of triboelectricity between the sweep roller and the cleaning member is eliminated and thereby stable developing bias can be applied to the developing roller. Further, discharge due to the electrified charge is eliminated and thereby electrical noise can be prevented from occurrence.

According to this invention, the sweep roller is formed of an elastic body. Thus, it is possible to surely remove excess toner, prevent image fog, and reduce consumption of carrier liquid.

According to this invention, the cylindrical members are disposed in both ends of the sweep roller. These members are smaller in outer dimension than that of the sweep roller in order to adequately adjust a sweep nip width. Thus, it is possible to form a sweep nip width with stability, reduce a contact pressure of the sweep roller against the latent image carrier, and enhance durability of the roller.

According to this invention, the sweep roller is formed in a multilayer structure including a core metal and an elastic layer with at least one layer. Thus, the sweep roller can obtain desired elasticity and electrical resistivity.

According to this invention, the volume resistivity of the sweep roller is adequately set to $10^9$ ohms-cm or below, thus applying a sweep voltage without its leakage and preventing abnormal images.

According to this invention, the hardness of the sweep roller is adequately set to 50 degrees (JIS-A) or below, thus preventing occurrence of image flow.

According to this invention, any material that does not deteriorate by the carrier liquid is selected as the material of the sweep roller, thus increasing durability of the sweep roller.

According to this invention, the value of surface roughness of the sweep roller is adequately set to 3 μm or below, thus preventing images from being affected by the surface smoothness of the sweep roller.

According to this invention, the material of the sweep roller is formed of urethane base resin as a main component, thus realizing desired elasticity and electrical resistivity, and also preventing deterioration of the sweep roller.

According to this invention, the surface of the sweep roller is a film layer having a thickness of 100 μm or below. Thus, it is possible to obtain desired elasticity, prevent deterioration of the sweep roller, and prevent adhesion of toner to the roller.

According to this invention, the surface of the sweep roller is a film layer having a volume resistivity of $10^9$ ohms-cm or below. Thus, it is possible to maintain a desired electrical resistivity in the sweep roller, prevent deterioration of the sweep roller, and prevent adhesion of toner to the roller.

According to this invention, the sweep roller is a foam, which makes it easy to impart adequate elasticity to the sweep roller and to set electrical resistivity to a desired value. Thus, it is possible to prevent deterioration of the sweep roller and prevent adhesion of toner to the roller.

According to this invention, the material of the sweep roller is formed of silicone base resin as a main component to obtain desired electrical resistivity and elasticity. Thus, it is possible to prevent deterioration of the sweep roller and prevent adhesion of toner to the roller.

According to this invention, the developer carrier is formed of urethane base resin. Thus, it is possible to ensure an optimal developing nip width for visualizing a latent image on the latent image carrier, reduce an amount of oil-repellent used to ensure flexibility of the developer carrier to be put into carrier liquid, and prevent image degradation due to deterioration of the liquid developer. Further, the developer carrier does not swell, and thereby deterioration of the developer carrier itself can be prevented. As a result, durability for outputting high quality images can be prolonged.

According to this invention, the developer carrier of the liquid developing device is formed to a belt-like carrier, Thus, it is possible to obtain a developing nip width comparatively broader and freely arrange the layout of the developing device.

According to this invention, when the hardness of the developer carrier for the liquid developing device is set to 60 degrees (JIS-A) or below, the developing nip width can be obtained comparatively broader. Therefore, the substrate may be a hard material having a hardness of 60 degrees (JIS-A), thus making an allowance for manufacture of the developer carrier.

According to this invention, a roller-like developer carrier is used in the liquid developing device, and thereby components required for a developing process can be suppressed to a minimum, and the developing device can be reduced in size.

According to this invention, the roller-like developer carrier is allowed to have such flexibility that the hardness is up to 40 degrees (JIS-A), and thereby a sufficient developing nip width required for transfer of toner can be obtained.

According to this invention, the developer carrier is made conductive such that the electrical resistivity between the surface of the roller-like developer carrier and its roller shaft is $10^9$ ohms or below, and thereby developing bias required for visualization of an image can act effectively on the surface of the developer carrier without variations in potentials.

According to this invention, the value of surface roughness on the surface of the developer carrier is set to 3 μm or below so that the surface is made smooth, and thereby a toner image can be uniformly formed on the latent image carrier.

According to this invention, the developer carrier is provided with a conductive surface layer, which makes it possible to effectively act the developing bias without unevenness and maintain flexibility of urethane base resin as the developer carrier.

According to this invention, the surface of the latent image carrier is formed of amorphous silicon. Therefore, it is possible to reduce damages due to contact of the developer carrier with the surface of the latent image carrier, and reduce deterioration due to carrier's absorption of oil and swelling thereby, and thereby the life of the latent image carrier can be prolonged.

According to this invention, the liquid developing device comprises the development voltage applying unit which applies a voltage to the developer carrier. More specifically, this voltage produces an electric field having a direction that moves the liquid developer to the latent image carrier when a latent image on the latent image carrier is developed with the liquid developer carried on the developer carrier. The liquid developing device also comprises the sweep voltage applying unit which applies a voltage to the sweep roller. More specifically, the voltage produces an electric field having a direction that attracts excess liquid developer or toner to the sweep roller in order to remove the excess liquid developer or toner adhering to or floating around the surface of the latent image carrier or its periphery after development, and the electric field is not so strong as the toner adhering the developed latent image on the latent image carrier is peeled. Accordingly, the development voltage applying unit moves toner to the surface (image portion side) of the latent image carrier to develop the latent image (image portion). Further, the sweep voltage applying unit moves stray excess toner present on the background toward the sweep roller to remove it without peeling the toner adhering to the image portion, and thereby it is possible to efficiently recover excess toner and prevent surface fog.

According to this invention, in the liquid developing device, the surface moving speed of the developer carrier is made substantially equal to that of the latent image carrier, and thereby image unevenness can be reduced.

According to this invention, in the liquid developing device, the surface moving speed of the sweep roller is substantially equal to that of the latent image carrier. Therefore, the surface of the sweep roller and the surface of the latent image carrier move at substantially the same speed as each other and inhibit the toner from having a relative velocity vector in the tangential direction of the latent image carrier, thus reducing image unevenness.

According to this invention, in the liquid developing device, toner contains pigment and the thickness of a liquid developer to be applied to the developer carrier is set so that a pigment content in the toner carried on the surface of the developer carrier per square cm is within a range from 0.1 μg to 2 μg, thus reducing image unevenness.

According to this invention, the liquid developing device is provided with the cleaning unit for cleaning the surface of the developer carrier and with the cleaning unit for cleaning the surface of the sweep roller, thus preventing a ghost image from adhering to the latent image carrier.

According to this invention, the liquid developing device can be used for the liquid image formation apparatus which comprises the latent image carrier, latent image forming unit that forms a latent image on the latent image carrier, developing unit that visualizes the latent image on the latent image carrier, and the transfer unit that transfers the visualized image on the latent image carrier to a transfer material.

The present document incorporates by reference the entire contents of Japanese priority documents, 2001-014212 filed in Japan on Jan, 23, 2001, 2001-076030 filed in Japan on Mar. 16, 2001, 2001-084682 filed in Japan on Mar. 23, 2001 and 2001-085829 filed in Japan on Mar. 23, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A liquid image formation apparatus comprising:

a latent image carrier configured to carry a latent image on an outer latent image carrier surface;

a latent image carrier drive unit configured to cause the outer latent image carrier surface to move;

a latent image exposing unit configured to form the latent image on the outer latent image carrier surface;

a developer unit including, a developer carrier configured to carry a liquid developer including a carrier liquid and toner dispersed therein on an outer developer carrier surface thereof, and an applying unit which applies said liquid developer to said outer developer carrier surface in a predetermined area with a predetermined width; and a removing unit configured to remove excess toner on said outer latent image carrier surface, wherein said outer developer carrier surface and said outer latent image carrier surface are configured to face each other so as to apply toner from the outer developer carrier surface to the outer latent image carrier surface in a development area to develop the latent image on the outer latent image carrier surface into a developed image and the removing unit is located downstream from said development area in a direction in which the outer latent image carrier surface is moved by the latent image carrier drive unit, and wherein said removing unit is further configured to remove the excess toner over a removal area having a width that is broader than the predetermined width of the predetermined area.

2. The liquid image formation apparatus according to claim 1, wherein said removing unit comprises, a removing member provided with a removing surface facing said outer latent image carrier surface that removes the excess toner therefrom by transferring said excess toner thereto, and a removing member cleaning member configured to be in contact with the removing surface and to remove said excess toner therefrom, wherein said removing member cleaning member has a width wider than a width of said removing member.

3. The liquid image formation apparatus according to claim 1, further comprising:

a charger configured to provide a uniformly-charged area on the outer latent image carrier surface, wherein said latent image exposing unit is further configured to perform an exposure to form the latent image adjacent to a non-image portion on the uniformly-charged area, wherein said removing unit includes a removing member which is provided facing said outer latent image carrier surface and removes said excess toner therefrom by transferring said excess toner thereto, and wherein said uniformly-charged area is formed so as to cover all of an area where said removing member faces said outer latent image carrier surface.

4. The liquid image formation apparatus according to claim 1, further comprising:

a transfer unit configured to transfer the developed image from the outer latent image carrier surface to a transfer medium, wherein the removal area is broader than a transfer-medium facing area in which said transfer medium faces the outer latent image carrier surface.

5. The liquid image formation apparatus according to claim 1, further comprising:

a transfer unit configured to transfer the developed image from the outer latent image carrier surface to a transfer medium; and a latent image carrier cleaning unit configured to clean the outer latent image carrier surface after the developed image is transferred to said transfer medium, wherein said removing unit includes a removing member which is provided in contact with said outer latent image carrier surface in a contact area that is configured to remove said excess toner therefrom by transferring said excess toner thereto, and wherein said latent image carrier cleaning unit cleans the outer latent image carrier surface over an area thereof that is wider than the contacted area.

6. The liquid image formation apparatus according to claim 1, further comprising:

an excess toner recycle unit configured to recycle excess toner removed from the outer latent image carrier surface by said removing unit by supplying the removed excess toner to a tank section configured to supply the liquid developer to the applying unit.

7. The liquid image formation apparatus according to claim 1, further comprising:

a transfer unit configured to transfer the developed image from the outer latent image carrier surface to a transfer medium;

an after-transfer residual toner cleaning unit configured to clean residual toner remaining on the outer latent image carrier surface after the developed image is transferred to said transfer medium; and an after-transfer residual toner recycle unit configured to recycle the after-transfer residual toner removed from the outer latent image carrier surface by said after-transfer residual toner cleaning unit by supplying the removed after-transfer residual toner to a tank section configured to supply the liquid developer to the applying unit.

* * * * *